US009150015B2

(12) United States Patent
Mishima

(10) Patent No.: US 9,150,015 B2
(45) Date of Patent: Oct. 6, 2015

(54) IMAGE PRODUCING APPARATUS AND IMAGE PRODUCING METHOD

(71) Applicant: FUJIFILM Corporation, Tokyo (JP)

(72) Inventor: Takahiro Mishima, Kanagawa-ken (JP)

(73) Assignee: FUJIFILM CORPORATION, Tokyo (JP)

( * ) Notice: Subject to any disclaimer, the term of this patent is extended or adjusted under 35 U.S.C. 154(b) by 0 days.

(21) Appl. No.: 14/044,780

(22) Filed: Oct. 2, 2013

(65) Prior Publication Data

US 2014/0098152 A1 Apr. 10, 2014

(30) Foreign Application Priority Data

Oct. 5, 2012 (JP) ..... 2012-223665

(51) Int. Cl.

| | |
|---|---|
| ***B41J 2/07*** | (2006.01) |
| ***B41J 2/21*** | (2006.01) |
| ***B41J 2/175*** | (2006.01) |
| ***B41J 29/38*** | (2006.01) |

(52) U.S. Cl.

CPC .. *B41J 2/07* (2013.01); *B41J 2/175* (2013.01); *B41J 2/2114* (2013.01); *B41J 2/2121* (2013.01); *B41J 29/38* (2013.01)

(58) Field of Classification Search

CPC ..... H04N 1/40087; H04N 1/60; H04N 2201/33378; B41J 19/147; B41J 2/07

USPC ..... 347/14, 15, 19, 43, 47, 57

See application file for complete search history.

(56) References Cited

U.S. PATENT DOCUMENTS

| | | | | |
|---|---|---|---|---|
| 7,198,345 | B2 * | 4/2007 | Shibata et al. | 347/15 |
| 2012/0022189 | A1 | 1/2012 | Koganehira | |
| 2012/0229549 | A1 * | 9/2012 | Shibata | 347/15 |

FOREIGN PATENT DOCUMENTS

| | | | |
|---|---|---|---|
| JP | 2005-313635 | A | 11/2005 |
| JP | 2007-276400 | A | 10/2007 |
| JP | 2012-025859 | A | 2/2012 |

OTHER PUBLICATIONS

Japanese Office Action dated Nov. 25, 2014 with a partial English translation.

Japanese Office Action dated May 26, 2015 with a partial English translation.

* cited by examiner

*Primary Examiner* — Thinh Nguyen

(74) *Attorney, Agent, or Firm* — McGinn IP Law Group, PLLC.

(57) ABSTRACT

A control signal is generated, so that if dots, which are formed in a transverse direction across a recording medium, are classified into plural groups depending on a plurality of timings, then preceding dots, which belong to a group having an earliest timing, are formed in a pale color. A head drive circuit controls a recording head based on the generated control signal.

10 Claims, 19 Drawing Sheets

IMAGE PRODUCING APPARATUS AND IMAGE PRODUCING METHOD

CROSS-REFERENCE TO RELATED APPLICATION

This application is based upon and claims the benefit of priority from Japanese Patent Application No. 2012-223665 filed on Oct. 5, 2012, the contents of which are incorporated herein by reference.

BACKGROUND OF THE INVENTION

1. Field of the Invention

The present invention relates to an image producing apparatus and an image producing method for producing an image by forming dots in a plurality of colors on a recording medium.

2. Description of the Related Art

With significant advances in inkjet technology in recent years, it is becoming possible for inkjet image producing apparatus to produce large color prints of high quality at high speeds. Inkjet image producing apparatus are widely used particularly in sign and display applications, and are applicable to, for example, prints on POP (Point Of Purchase) posters, wall posters, outdoor advertisements, billboards, etc. Such inkjet image producing apparatus are capable of producing prints by forming a number of ink dots on a recording medium, by applying droplets made up from a plurality of inks to the recording medium.

If an inkjet image producing apparatus is designed to produce images at higher speeds and to achieve a higher density of dots, then the inkjet image producing apparatus tends to suffer from problems due to interference between ink droplets that are deposited on the recording medium. Interference between deposited ink droplets refers to a phenomenon in which, before an ink droplet that has been deposited on the image producing surface of a recording medium becomes fully fixed to the image producing surface, a subsequent ink droplet is deposited on the image producing surface in the vicinity of the prior ink droplet, whereby the prior and subsequent ink droplets combine with one another. If the ink droplets are combined with each other in this manner, the ink droplets become shifted and united together under surface tension. Since at this time the center of gravity of the dot formed by the subsequent ink droplet is displaced, the resultant image is likely to suffer from low granularity and gloss irregularities, resulting in poor image quality and appearance.

Various inkjet technologies have been proposed for appropriately controlling recording heads for expelling ink droplets to produce high-quality images in view of the adverse effects caused by interference between deposited ink droplets on the images.

According to Japanese Laid-Open Patent Publication No. 2005-313635, there has been proposed a method of and an apparatus for controlling ejection of ink droplets, so as to deliver the in droplets in successively greater amounts of ink upon successive discharge of the ink droplets from a recording head. The ink droplets, which are expelled in successively greater amounts of ink, are able to produce a line image having a uniform width on a recording medium, even if the ink droplets interfere with each other in a case where the ink droplets are deposited on the recording medium.

SUMMARY OF THE INVENTION

The present invention has been made in relation to the technical concept disclosed in Japanese Laid-Open Patent Publication No. 2005-313635.

It is an object of the present invention to provide an image producing apparatus and an image producing method, which are capable of minimizing poor image quality and appearance caused by interference between deposited ink droplets.

According to the present invention, there is provided an image producing apparatus comprising a recording head for ejecting ink droplets to form dots in a plurality of colors having different shades on a recording medium, a head drive circuit for controlling the recording head based on a control signal to successively form the dots at a plurality of timings on the recording medium, to thereby generate image arrays in a transverse direction across the recording medium while the recording medium is moved in a feed direction with respect to the recording head, and an image processor for generating the control signal, which is supplied to the head drive circuit, from an input image signal, so that if the dots formed along the transverse direction are classified into plural groups depending on the plurality of timings, then preceding dots, which belong to a group having an earliest timing, are formed in a pale color.

As described above, if the dots that are formed along the transverse direction are classified into plural groups depending on a plurality of timings, then the preceding dots, which are dots belonging to the group having the earliest timing, are formed in a pale color. Consequently, any adverse physical effects due to interference between the deposited ink droplets can be reduced, and the shape of the dots produced by the deposited ink droplets can be controlled appropriately.

More specifically, the ink droplets (preceding ink droplets), which are ejected at an earliest timing during production of the image arrays along the transverse direction, are effective to hold ink droplets (first ink droplets), which are ejected subsequently toward positions in the vicinity of the deposited preceding ink droplets, and to prevent the ink droplets (first ink droplets) from being shifted toward other ink droplets (second ink droplets). Accordingly, interference between deposited ink droplets is prevented from occurring in succession, so that a reduction in the quality and appearance of an image, caused by interferences between the deposited ink droplets, can be suppressed. In particular, since the preceding ink droplets are pale in color, even if the ink droplets become united with the subsequently deposited first ink droplets, any adverse effect on the resultant image due to mixed colors is minimized.

The image processor preferably includes a halftoning processor for performing a halftoning process on the input image signal to generate an image dot signal, and a preceding dot signal generator for generating a preceding dot signal representing information concerning the preceding dots based on the input image signal, wherein the control signal is made up of the image dot signal generated by the halftoning processor and the preceding dot signal generated by the preceding dot signal generator.

The preceding dot signal generator preferably generates the preceding dot signal, so as to form the preceding dots at positions identical or adjacent to dots in a deep color, in a density gradation range that is equal to or greater than a preset threshold value.

The image producing apparatus preferably further includes a scanning driver for reciprocally moving the recording head along the transverse direction, and a feed driver for feeding the recording medium along the feed direction.

The image processor preferably generates the control signal by successively combining the preceding dot signal and the image dot signal alternately in respective scanning strokes of the recording head, and the head drive circuit preferably controls the recording head based on the preceding dot signal in a forward scanning stroke of the recording head that is moved by the scanning driver, and controls the recording head based on the image dot signal in a backward scanning stroke of the recording head occurring subsequently to the forward scanning stroke.

The recording head preferably includes nozzle arrays for respective colors, each of the nozzle arrays having at least two nozzles extending in the feed direction for ejecting the ink droplets, and the nozzle arrays preferably include preceding nozzles for ejecting ink droplets in a pale color, the preceding nozzles being positioned upstream of all remaining nozzles of the nozzle arrays, which are capable of ejecting ink droplets in at least one remaining color.

The head drive circuit preferably controls the recording head based on the preceding dot signal, so as to cause the preceding nozzles to eject the ink droplets in the pale color, and controls the recording head based on the image dot signal to cause the remaining nozzles to eject the ink droplets.

The recording head preferably forms the dots in at least two sizes on the recording medium, and the image processor preferably generates the control signal to form the preceding dots in a smallest one of the at least two sizes.

The plural colors preferably include a transparent color, and the image processor preferably generates the control signal to form the preceding dots in the transparent color.

The recording head preferably ejects the ink droplets, which are made up of inks that are curable upon exposure to active light rays, and the image producing apparatus preferably further includes curing light sources for applying the active light rays to the ink droplets, which are deposited on the recording medium.

According to the present invention, there also is provided an image producing method to be carried out by an apparatus having a recording head for ejecting ink droplets to form dots in a plurality of colors having different shades on a recording medium, wherein the dots are successively formed at a plurality of timings on the recording medium, to thereby generate image arrays in a transverse direction across the recording medium while the recording medium is moved in a feed direction with respect to the recording head, the image producing method comprising the steps of inputting an image signal, generating a control signal from the input image signal, so that if the dots formed along the transverse direction are classified into plural groups depending on the plurality of timings, then preceding dots, which belong to a group having an earliest timing, are formed in a pale color, and controlling the recording head based on the generated control signal.

With the image producing apparatus and the image producing method according to the present invention, if the dots that are formed along the transverse direction are classified into plural groups depending on a plurality of timings, then the preceding dots, which are dots belonging to the group having the earliest timing, are formed in a pale color. Consequently, any adverse physical effect due to interference between the deposited ink droplets can be reduced, and the shape of the dots produced by the deposited ink droplets can be controlled appropriately.

More specifically, the ink droplets (preceding ink droplets), which are ejected at an earliest timing during production of the image arrays along the transverse direction, are effective to hold ink droplets (first ink droplets), which are ejected subsequently toward positions in the vicinity of the deposited preceding ink droplets, and to prevent the ink droplets (first ink droplets) from being shifted toward other ink droplets (second ink droplets). Accordingly, interference between deposited ink droplets is prevented from occurring in succession, so that a reduction in the quality and appearance of an image, caused by interference between the deposited ink droplets, can be suppressed. In particular, since the preceding ink droplets are pale in color, even if the ink droplets become united with the subsequently deposited first ink droplets, any adverse effect on the resultant image due to mixed colors is minimized.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Image producing methods according to preferred embodiments of the present invention in relation to image producing apparatus for carrying out the image producing methods will be described in detail below with reference to the accompanying drawings. In the following description, the production of an image will also be referred to as "printing" or "typing".

[Features of Image Producing Methods According to First and Second Embodiments]

First, features of image producing methods according to first and second embodiments of the present invention will be described below with reference to FIGS. 1 through 3.

Figure 1:
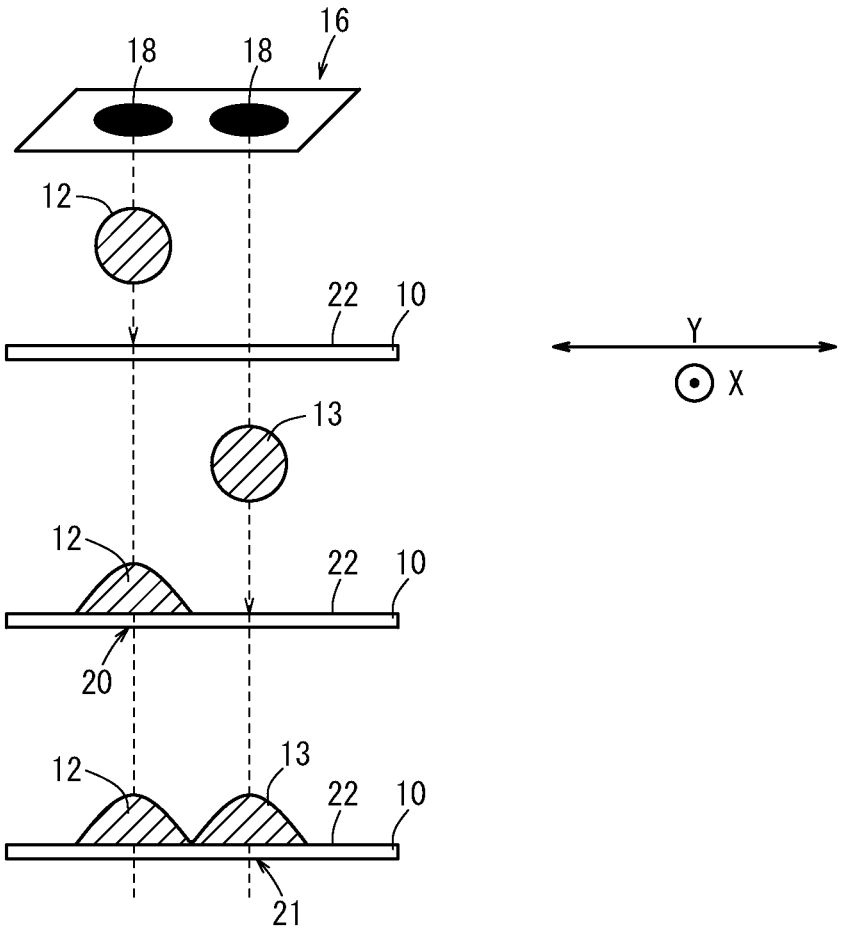
FIG. 1 is a schematic diagram showing a time sequence of a dot formation process.
Figure 2:
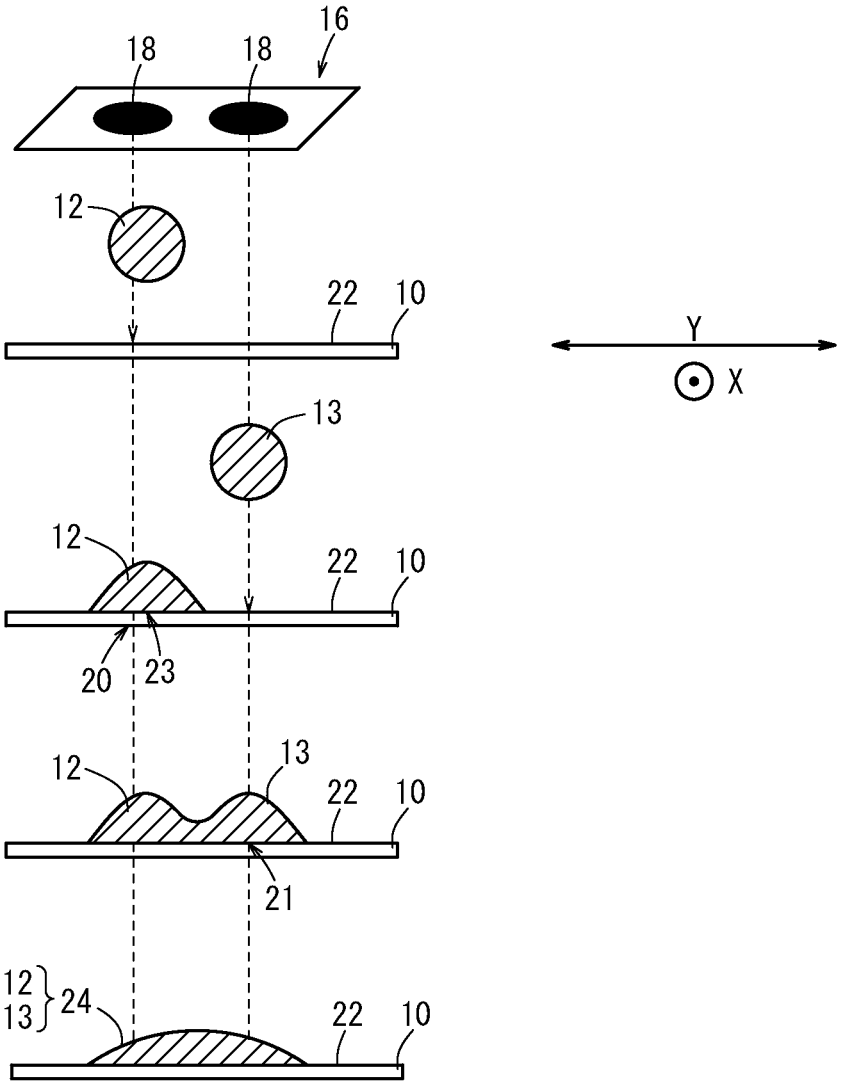
FIG. 2 PRIOR ART
FIG. 2 is a schematic diagram showing a time sequence of a dot formation process.

FIGS. 1 and 2 are schematic diagrams each of which shows a time sequence for the formation of dots. FIGS. 1 and 2 illustrate transition states of ink droplets 12, 13, which are expelled successively from a recording head 16, shown partially, toward a recording medium 10. The ink droplets 12, 13 are ejected respectively from a plurality of nozzles 18 of the recording head 16. It is assumed that the ink droplets 12, 13 are expelled successively toward positions on the recording medium 10, which are disposed adjacent to each other along the direction of the arrow Y, i.e., transversely across the recording medium 10, at respective times that differ from each other by a relatively small period.

In FIG. 1, the ink droplet 12 is deposited at a target position 20, and the ink droplet 13 is deposited at a target position 21.

More specifically, the ink droplet 12 is expelled first and deposited at the target position 20 on an image producing surface 22 of the recording medium 10. The ink droplet 12, which has been deposited, has a portion that is absorbed by the recording medium 10 with the remainder thereof, which includes a pigment, being left on the image producing surface 22. Thereafter, the ink droplet 13 is expelled subsequently and deposited at the target position 21 on the image producing surface 22. In order to prevent degradation in the quality of an image that is produced on the recording medium 10, the target positions 20, 21 are spaced apart from each other by a predetermined distance for preventing the ink droplets 12, 13 from interfering with each other. In other words, the ink droplets 12, 13 are deposited with high positional accuracy in order to form two individual dots, respectively, on the recording medium 10 such that the ink droplets 12, 13 do not overlap each other.

In FIG. 2, the ink droplet 13 is deposited at the target position 21, whereas the ink droplet 12 is deposited at a position that deviates from an intended position as a result of the fact that the nozzle 18 that ejects the ink droplet 12 is bent.

More specifically, the ink droplet 12 is expelled first and is deposited at a position 23 on the image producing surface 22 of the recording medium 10. The position 23 is deviated from the target position 20, i.e., is closer to the target position 21 for the ink droplet 13 than the target position 20 for the ink droplet 12. Thereafter, the ink droplet 13 is expelled subsequently and is deposited at the target position 21 on the image producing surface 22. Since the distance between the position 23 and the target position 21 is smaller than intended, the ink droplets 12, 13 become joined together since the ink droplets 12, 13 interfere with each other in a case where the ink droplets 12, 13 are deposited. At this time, the ink droplets 12, 13 are shifted and are united together under surface tension, thereby forming a unitary ink droplet 24. As a result, the intended profiles of the two dots become blurred, which tends to result in poor image quality and appearance.

More specifically, in the case that the ink droplets 12, 13 become united with each other, the resultant dot has a large dot size. Therefore, the produced image is made up of dots having shapes that are easier to recognize, thereby resulting in greater noise and granularity. Even an image made up of a regular matrix of such dots, such as a plain halftone image, may have the surface smoothness thereof on the image producing surface 22 locally impaired owing to the image producing process. If the surface smoothness is locally impaired, then the image suffers from a phenomenon known as gloss banding, in which glossiness appears differently depending on the angle at which the image is observed.

Figure 3:
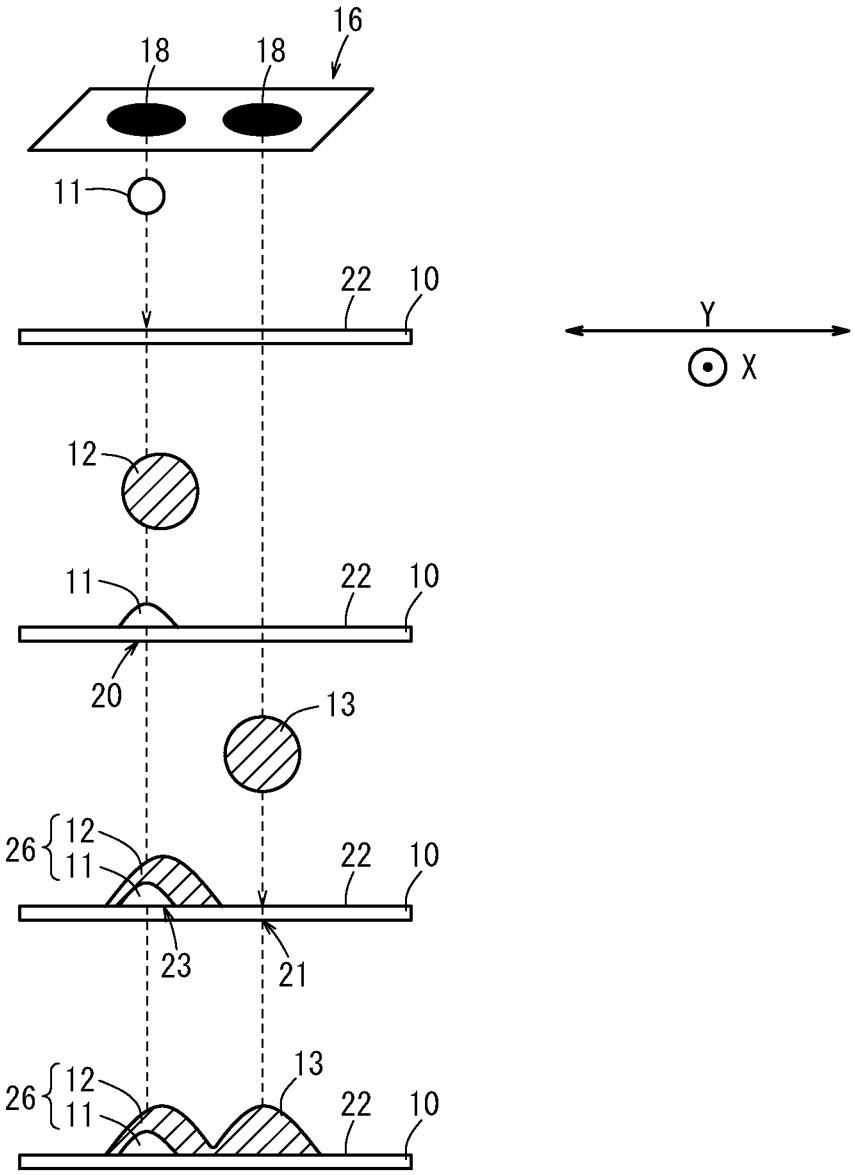
FIG. 3 is a schematic diagram showing a time sequence of a dot formation process, which is implemented in an image producing method common to respective embodiments of the present invention.

FIG. 3 is a schematic diagram showing a time sequence of a dot formation process in an image producing method, which is common to respective embodiments of the present invention. The image producing method is characterized in that the expelled ink droplet 12 is preceded by an ink droplet 11 (hereinafter referred to as a "preceding ink droplet 11"), which is paler than the ink droplet 12. The ink droplet 12 shown in FIG. 3 corresponds to the ink droplet 12 shown in FIGS. 1 and 2, which is expelled (deposited) at an earliest timing among a series of dots along the direction of the arrow Y.

The formation of dots in FIG. 3, in which the ink droplet 12 is deposited at a position that deviates from the intended position as shown in FIG. 2, will be described below. It is assumed that the nozzle 18, which discharges the preceding ink droplet 11, is normal, so that the preceding ink droplet 11 is deposited at a target position 20 on the recording medium 10 in FIG. 3.

The preceding ink droplet 11 that is expelled at the earliest timing from the nozzle 18 is deposited at the target position 20 on the image producing surface 22 of the recording medium 10. The preceding ink droplet 11 that has been deposited has a portion absorbed by the recording medium 10, but the remainder thereof is left to remain on the image producing surface 22. Thereafter, the ink droplet 12 is expelled from the nozzle 18 shortly after the preceding ink droplet 11, and the ink droplet 12 is deposited at the position 23 on the image producing surface 22. At this time, since a frictional force is generated due to contact with the image producing surface 22, the remainder of the preceding ink droplet 11 is subject to a resistive force, which tends to prevent the remainder of the preceding ink droplet 11 from being shifted toward the ink droplet 12. The ink droplet 12 has a portion thereof attracted and shifted to the preceding ink droplet 11, whereupon the preceding ink droplet 11 and the shifted portion of the ink droplet 12 jointly make up a unitary ink droplet 26 formed around the position 23. Thereafter, the ink droplet 13 is expelled from the nozzle 18 shortly after the ink droplet 12, and the ink droplet 13 is deposited at the position 21 on the image producing surface 22.

Inasmuch as the preceding ink droplet 11 is expelled and deposited in advance, as described above, even though the deposited position of the ink droplet 12 deviates from the target position 20, the ink droplets 12, 13 form two individual dots on the recording medium 10 where the ink droplets 12, 13 do not overlap each other. In other words, the preceding ink droplet 11, which is expelled (deposited) at the earliest timing from among the series of ink droplets along the direction of the arrow Y in FIG. 3, serves as an anchor that holds the subsequently expelled ink droplet 12 and prevents the ink droplet 12 from being shifted toward the other ink droplet 13. The preceding ink droplet 11 remains effective to hold the subsequently expelled ink droplet 12, even if the ink droplets 12, 13 are expelled in a reverse order, i.e., the ink droplet 13 is expelled earlier than the ink droplet 12.

Depending on how the unitary ink droplet 26 (see FIG. 3) is layered, the color of the preceding ink droplet 11 may become noticeable and be recognized visually as an image color irregularity or the like. Although the preceding ink droplet 11 may be of any given color, preferably, the preceding ink droplet 11 is a pale ink droplet. Thus, even if the preceding ink droplet 11, which is pale, becomes united with the ink droplet 12, any adverse effect that the mixed colors of the ink droplets 11, 12 have on the resultant image is minimized.

The term "pale" as used in the present disclosure implies a color having a relatively lower density from among a plurality of colors having different shades of color that are used to produce an image, and refers to a concept including a transparent color (clear). For example, if five colors of yellow (Y), magenta (M), cyan (C), black (K), and clear (CL) are used to produce an image, the pale color refers to Y or CL. On the other hand, if seven colors of yellow (Y), magenta (M), cyan (C), black (K), light cyan (LC), light magenta (LM), and clear (CL) are used to produce an image, the pale color refers to at least one of the colors of Y, LC, LM, and CL.

[Configuration and Operations of Image Processor 30 According to First Embodiment]

Figure 4:
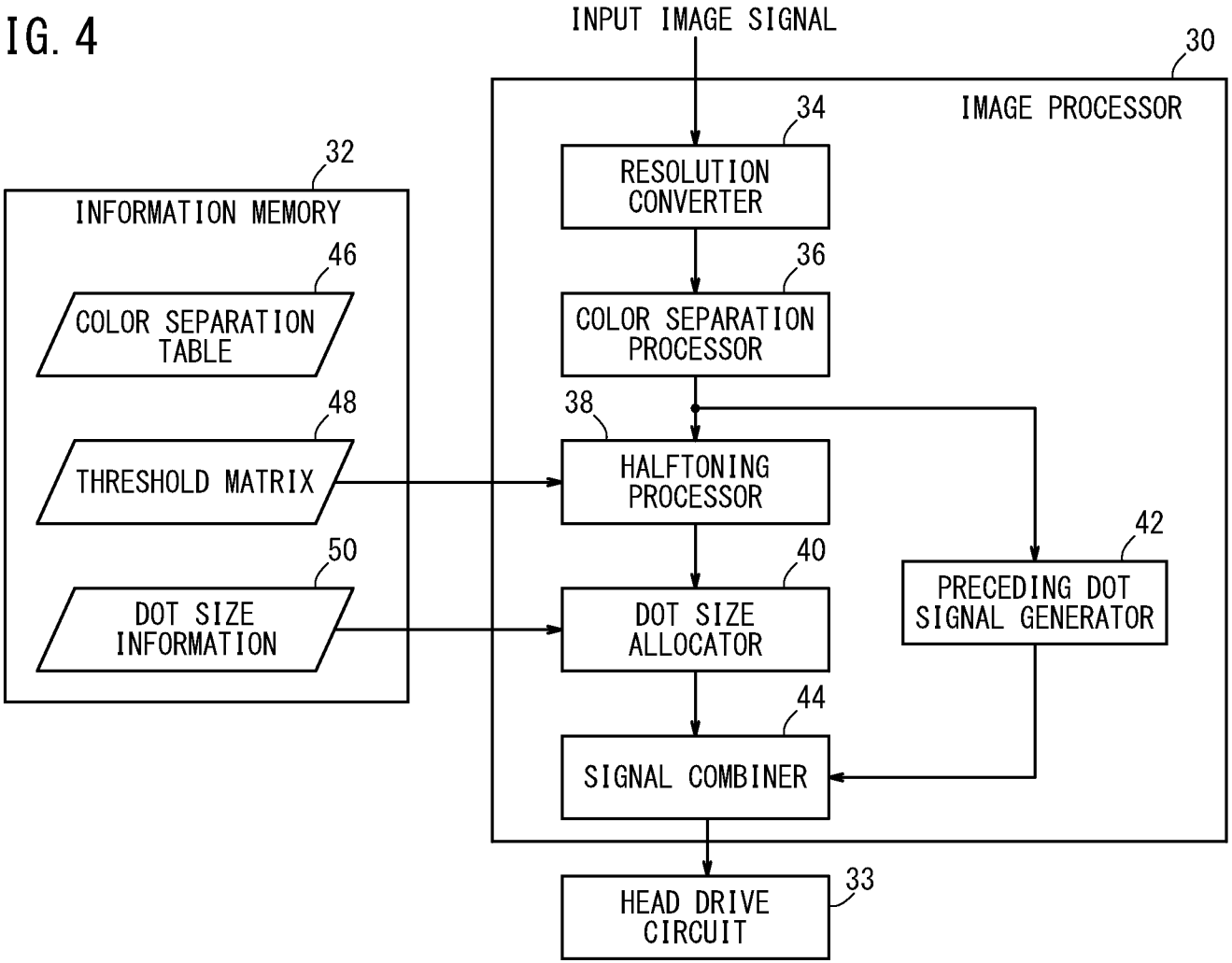
FIG. 4 is a functional block diagram of an image processor according to a first embodiment of the present invention.

FIG. 4 is a functional block diagram of an image processor 30 according to a first embodiment of the present invention. The image processor 30 reads various data from an information memory 32, and supplies a signal (hereinafter referred to as a "control signal") for controlling expulsion of ink droplets to a head drive circuit 33. The image processor 30 basically includes a resolution converter 34, a color separation processor 36, a halftoning processor 38, a dot size allocator 40, a preceding dot signal generator 42, and a signal combiner 44.

The information memory 32 stores various data required to carry out the image producing method according to the present embodiment. In FIG. 4, the information memory 32 stores a color separation table 46, a threshold matrix 48, and dot size information 50.

An image signal input to the image processor 30 (hereinafter referred to as an "input image signal") represents continuous-tone image data having a plurality of color channels. For example, the input image signal may be made up of 8-bit (256 gradations per pixel) RGB TIFF (Tagged Image File Format) data.

<1. Operations of Resolution Converter 34>

The resolution converter 34 converts the resolution of the input image signal into a resolution that depends on an image producing apparatus 100 (see FIG. 15, etc.) according to an image scaling process for scaling up or scaling down the image size. The resolution converter 34 generates a first intermediate image signal, which has the same data definition as the input image signal, but has a data size that differs from that of the input image signal. The image scaling process may be based on any of various known algorithms including interpolation.

<2. Operations of Color Separation Processor 36>

Figure 15:
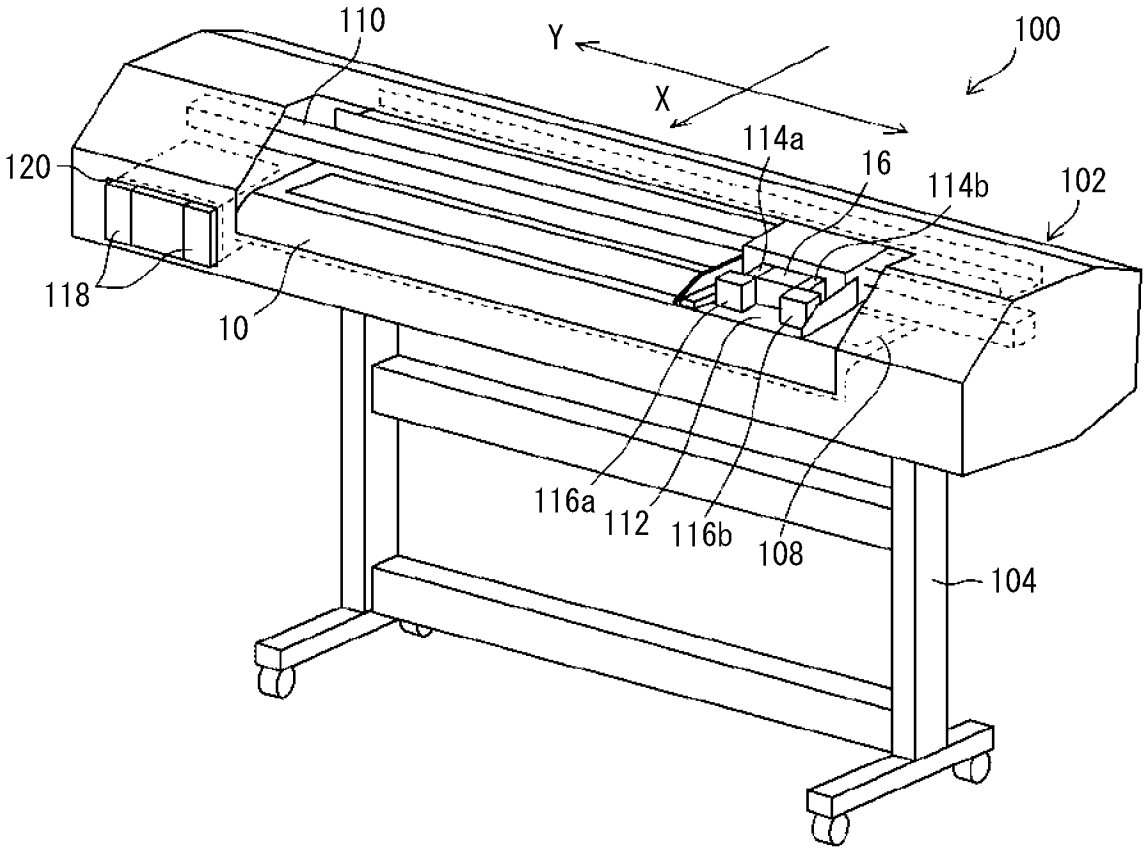
FIG. 15 is a perspective view of an image producing apparatus common to the first and second embodiments.

The color separation processor 36 converts the first intermediate image signal acquired from the resolution converter 34 into device color signals, which are handled by the image producing apparatus 100 (see FIG. 15, etc.). More specifically, the color separation processor 36 converts R, G, B color signals into C, M, Y, K color signals by reading and referring to the color separation table 46 stored in the information memory 32. If the color separation processor 36 includes a color shade table for separating different shades of color, then the color separation processor 36 may also separate device color signals of certain color channels (e.g., cyan and magenta) into color channel signals similar to those of the certain color channels.

The color separation processor 36 generates a second intermediate image signal, which is made up of multi-gradation device color signals. For example, the color separation processor 36 converts the first intermediate image signal into device color signals in five color channels, i.e., yellow (Y), magenta (M), cyan (C), black (K), and clear (CL).

<3. Operations of Halftoning Processor 38>

The halftoning processor 38 shown in FIG. 4 converts the second intermediate image signal, which is acquired from the color separation processor 36, into a binary image signal, as a halftone signal representing whether a dot is ON or OFF, according to a halftoning process. The halftoning process may be an ordered dither method, an error diffusion method, a density pattern method, a random dot method, or the like. According to the present embodiment, an ordered dither method is used as the halftoning process.

Figure 5:
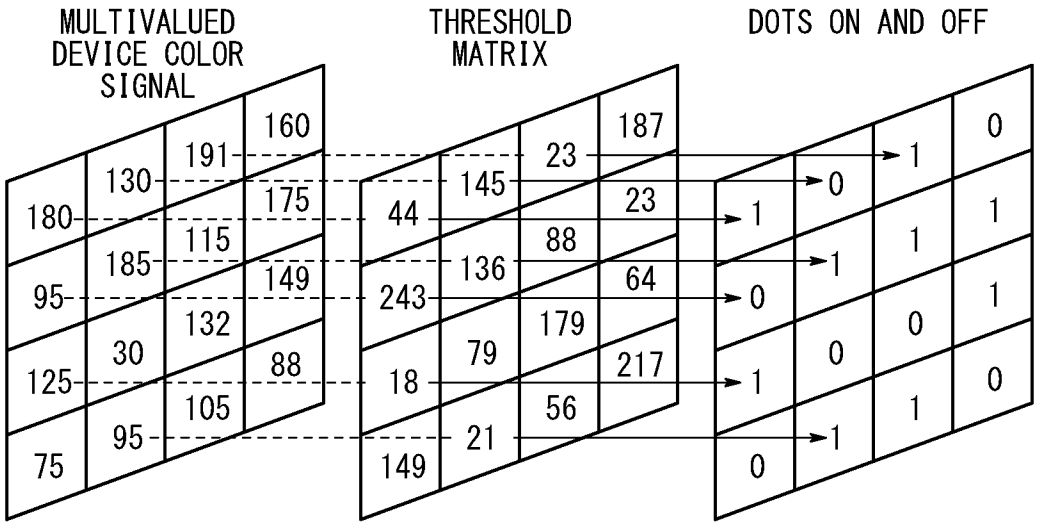
FIG. 5 is a diagram showing a halftoning process according to an ordered dithering method.
Figure 6:
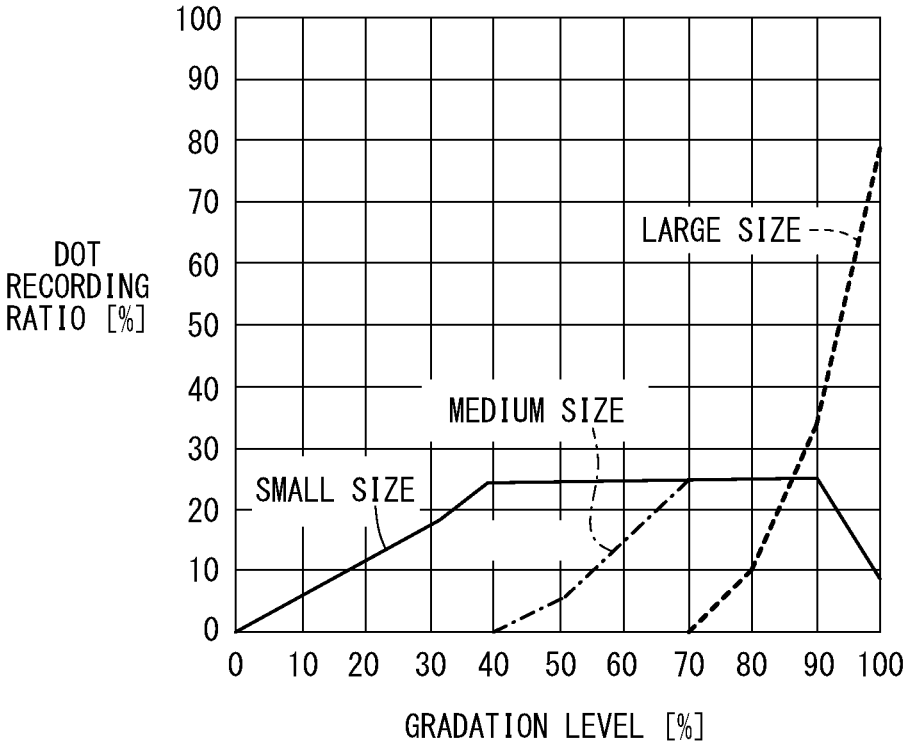
FIG. 6 is a graph showing an example of allocation characteristics for a plurality of dot sizes, in a dot size allocator shown in FIG. 4.

FIG. 5 is a diagram showing a halftoning process according to an ordered dither method. FIG. 6 shows conceptually a binarizing process based on a Bayer-pattern threshold matrix (mask pattern). Addresses of multi-gradation image signals are associated respectively with matrix elements of the threshold matrix. The pixel value of a pixel in question is compared in magnitude with the threshold value of a corresponding matrix element. If the pixel value is greater than the threshold value, then "1 (ON)" is assigned to the image signal, whereas otherwise, "0 (OFF)" is assigned to the image signal. In this manner, the gradation of the image signal is converted from a multi-value level into a binary level.

<4. Operations of Dot Size Allocator 40>

The dot size allocator 40 shown in FIG. 4 allocates dot sizes to the positions of each pixel that is ON (has a pixel value of 1), from among a plurality of pixels represented by the binary image signal acquired from the halftoning processor 38. After dot sizes have been allocated thereto, the halftone signal, i.e., the binary image signal, is referred to as an "image dot signal" in order to distinguish the halftone signal from a preceding dot signal, to be described later.

Figure 9B:
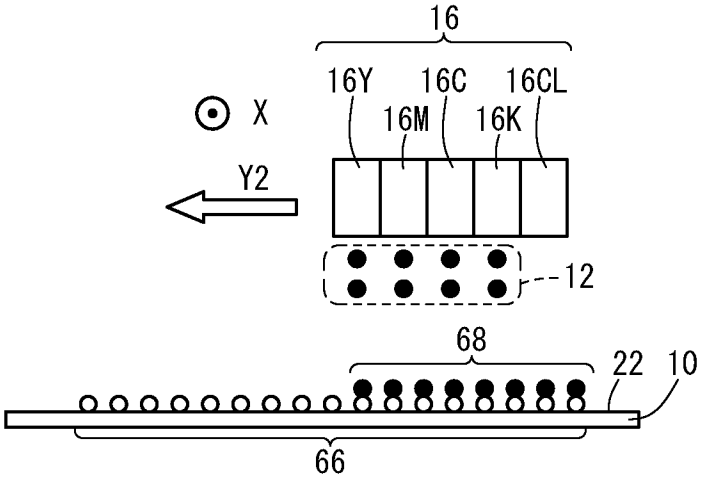
FIGS. 9A and 9B are schematic diagrams showing an example of an image producing method using a bidirectional printing mode.
Figure 9A:
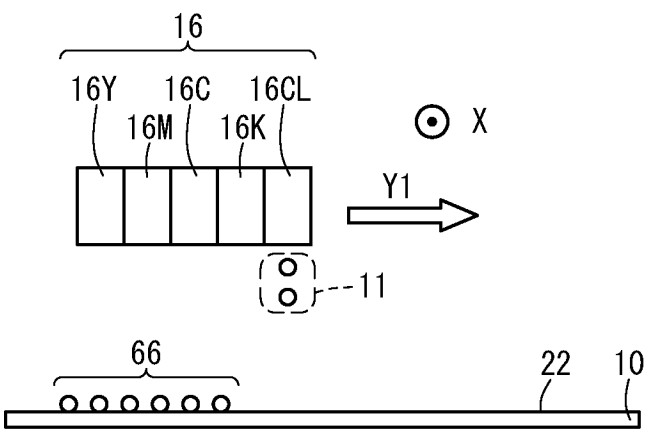

The dot size allocator 40 allocates "large size", "medium size", and "small size" to the ON pixels represented by the binary image signal, thereby generating a control signal, which is used to control the recording head 16 shown in FIG. 9A, etc., for controlling ejection of the ink droplets 12, etc. The control signal is made up of multi-valued data in respective colors for chronologically turning the recording head 16 on or off, or chronologically controlling the amounts of the ink droplets ejected from the recording head 16. If the control signal is of a multi-valued level of "0", then the control signal represents a pixel that is OFF. If the control signal is of a multi-valued level of "1", then the control signal represents a pixel that is ON and has a small size. If the control signal is of a multi-valued level of "2", then the control signal represents a pixel that is ON and has a medium size. If the control signal is of a multi-valued level of "3", then the control signal represents a pixel that is ON and has a large size. The dot size may be controlled by changing the amount at which the ink droplets 12 are expelled, etc., or by changing the speed at which the ink droplets 12 are expelled, etc.

FIG. 6 is a graph showing an example of allocation characteristics for a plurality of dot sizes, in the dot size allocator 40 shown in FIG. 4. The graph has a horizontal axis representing gradation levels by way of percentage (unit: %) and a vertical axis representing dot recording ratios (unit: %). The term "dot recording ratio" refers to a ratio of recorded dots to a maximum number of dots that can be formed (0 through 100%).

It is assumed that an ejection controller 168 (see FIG. 19) is capable of controlling the recording head 16 to form three types of dots, i.e., dots having a "large size", dots having a "medium size", and dots having a "small size", although the sizes of dots that can be formed are not limited to three types, but may be two types or four or more types.

As indicated by the graph in FIG. 6, the dot recording ratio of the "small size" dots increases monotonously in a range of gradation levels from 0 to 40%, is constant (approximately 25%) in a range of gradation levels from 40 to 90%, and decreases monotonously in a range of gradation levels from 90 to 100%. The dot recording ratio of "medium size" dots is nil in a range of gradation levels from 0 to 40%, increases monotonously in a range of gradation levels from 40 to 70%, is constant (approximately 25%) in a range of gradation levels from 70 to 90%, and decreases monotonously in a range of gradation levels from 90 to 100%. The dot recording ratio of the "large size" dots is nil in a range of gradation levels from 0 to 70% and increases monotonously in a range of gradation levels from 70 to 100%. Since only "small size" dots are used in a low-density gradation range, a good image with suppressed granularity is produced.

<5. Operations of Preceding Dot Signal Generator 42>

The preceding dot signal generator 42 shown in FIG. 4 generates a preceding dot signal representing information concerning preceding dots 66 (see FIGS. 9A and 9B), based on the second intermediate image signal acquired from the color separation processor 36. According to the present invention, it is assumed that among the inks in five colors of C, M, Y, K, and CL, the CL (clear) color ink is used to form the preceding dots 66. A preceding dot signal comprises a signal for controlling ejection of the preceding ink droplets 11, and has the same resolution as that of the halftone signal and the image dot signal referred to above.

Figure 7:
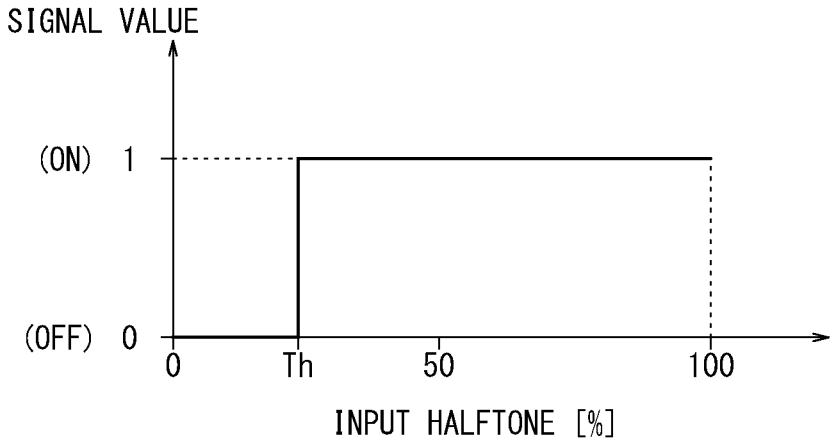
FIG. 7 is a graph showing an example of a definition and a process for determining signal values of a preceding dot signal.

FIG. 7 is a graph showing an example of a definition and process for determining signal values of the preceding dot signal. The graph has a horizontal axis representing the input halftone percentage (%) in colors C, M, Y, K, and a vertical axis representing the signal value of the preceding dot signal. Signal values of the preceding dot signal are defined such that, if the signal value of the preceding dot signal is 1, the preceding dots 66 are "ON", whereas if the signal value of the preceding dot signal is 0, the preceding dots 66 are "OFF". The graph shows that the signal value of the preceding dot signal is 0 in the case that the input halftone percentage (%) is smaller than a threshold value Th, for example, a value in a range from 20 to 40%, and the signal value of the preceding dot signal is 1 in the case that the input halftone percentage (%) is equal to or greater than the threshold value Th. In other words, a preceding dot 66 is formed at each of the pixels having an input halftone percentage (%) that is equal to or greater than the threshold value Th.

Figure 8A:
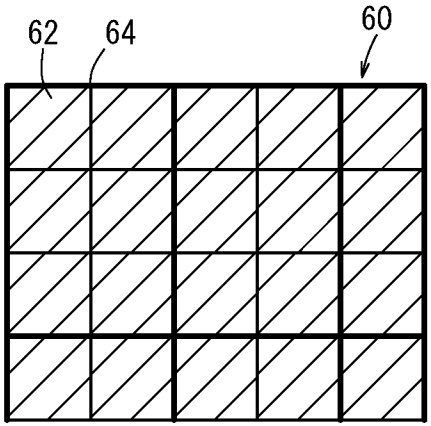
FIGS. 8A through 8C are schematic diagrams showing examples of a process for determining signal values of a preceding dot signal.
Figure 8B:
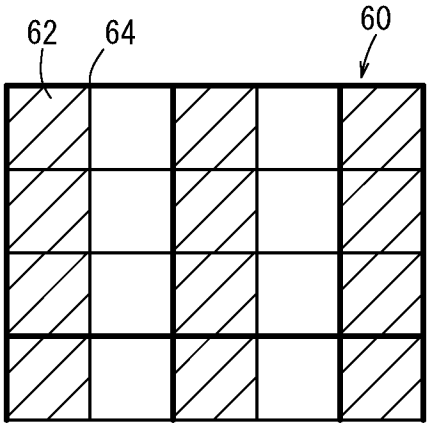
Figure 8C:
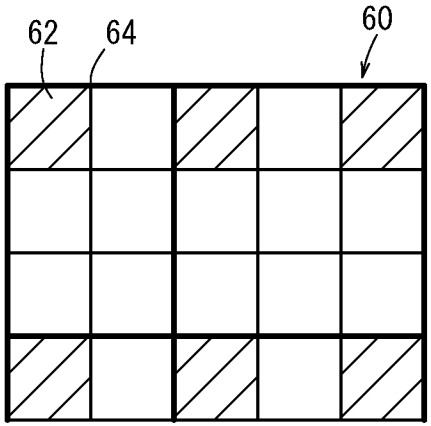

FIGS. 8A through 8C are schematic diagrams showing examples of a process for determining signal values of the preceding dot signal. More specifically, each of FIGS. 8A through 8C shows schematically an application range in which preceding dots 66 are "ON". In each of FIGS. 8A through 8C, an image area 60 is made up of a matrix of cells 62. According to the process for determining signal values of the preceding dot signal, the preceding dot 66 is "ON" in each of the cells 62 that are shown in hatching, and "OFF" in each of the cells 62 that are shown without hatching.

As shown in FIG. 8A, the preceding dots 66 are formed in advance for all the cells 62 to thereby reduce interference between deposited ink droplets throughout the entirety of the image. However, in this case, since the total number of preceding ink droplets 11, i.e., the total amount of inks used, is increased, the example shown in FIG. 8A is not preferred from the standpoint of cost. An image that is satisfactory both in terms of image quality and cost can be produced by reducing the proportion of the preceding dots 66 that are ON. More specifically, ink droplets may be ejected in a decimated fashion, so as to turn ON a preceding dot 66 for at least every other pixel, in a direction along at least the rows or columns of the image area 60.

In FIG. 8A, the image area 60 includes areas enclosed by thick lines, which serve as cluster areas 64 made up of dots in respective colors. Each of the cluster areas 64 comprises six cells arranged in three rows and two columns. As shown in FIG. 8B, only cells 62 that are present in left-hand columns of the cluster areas 64 may be turned "ON". Alternatively, as shown in FIG. 8C, only cells 62 that are present in upper left-hand corners of the cluster areas 64 may be turned "ON". Further, alternatively, the process for determining signal values of the preceding dot signal shown in FIG. 7 may be carried out in order to decide whether the preceding dot 66 should be turned "ON" or "OFF" with respect to the cells 62 that are shown in hatching in FIGS. 8A through 8C.

<6. Operations of Signal Combiner 44>

The signal combiner 44 shown in FIG. 3 combines an image dot signal, which is acquired from the dot size allocator 40, and a preceding dot signal, which is acquired from the preceding dot signal generator 42, thereby generating a control signal for controlling the recording head 16. More specifically, the signal combiner 44 successively combines image dot signals and preceding dot signals alternately in each scanning stroke of the recording head 16, thereby generating a control signal made up of combined dot signals. The control signal, which is generated in this manner, is suitable for a "bidirectional printing mode" in which the recording head 16 expels ink droplets in both forward and backward scanning strokes. The bidirectional printing mode, as well as the structure of the recording head 16, will be described in detail below. The image processor 30 supplies the generated control signal to the recording head 16.

<7. Operations of Recording Head 16>

While the recording medium 10 is delivered in a feed direction, i.e., in the direction of the arrow X, the recording head 16 is moved in forward and backward scanning strokes in a transverse direction, i.e., in the direction of the arrow Y, across the recording medium 10. In the bidirectional printing mode, the recording head 16 ejects the ink droplets 12, etc., toward the image producing surface 22 of the recording medium 10 while the recording head 16 moves respectively in forward and backward scanning strokes.

FIGS. 9A and 9B are schematic diagrams showing an example of an image producing method using the bidirectional printing mode. In FIGS. 9A and 9B, the recording head 16 includes five head modules 16Y, 16C, 16M, 16K, 16CL, which are arranged in this order successively from the left, and which are capable of ejecting the ink droplets 12, etc., in five colors of Y, C, M, K, and CL, respectively.

As shown in FIG. 9A, upon being supplied with preceding dot signals for a given scanning stroke, the recording head 16 ejects the preceding ink droplets 11 in the clear color (CL) toward the recording medium 10 while moving in a forward scanning stroke in the direction of the arrow Y1. Consequently, before ink droplets for producing an image are ejected from the recording head 16, the preceding dots 66 are formed in desired positions on the image producing surface 22. The desired positions refer to positions in which the input halftone percentage (%) is equal to or greater than the threshold value (e.g., 20%) and the density of the preceding dots 66 is relatively high.

As shown in FIG. 9B, upon being supplied with image dot signals for a given scanning stroke, the recording head 16 ejects the ink droplets 12 in colors of yellow (Y), cyan (C), magenta (M), and black (K) toward the recording medium 10 while moving in a backward scanning stroke in the direction of the arrow Y2. Certain ones of the ejected ink droplets 12 are deposited at positions identical or adjacent to the preceding dots 66, thereby forming dots 68 in deep colors. Since the recording head 16 repeatedly ejects the ink droplets 11, 12, etc., in forward (see FIG. 9A) and rearward (see FIG. 9B) scanning strokes, a desired image is produced made up of dots in different colors on the recording medium 10 according to the dot forming process shown in FIG. 3.

[Modifications of First Embodiment]

<First Modification>

According to the first embodiment, the transparent color (clear: CL) is used as a pale color. However, a non-transparent (chromatic) color including gray (Gy), light cyan (LC), light magenta (LM), or yellow (Y) may be used as a pale color.

<Second Modification>

According to the first embodiment, no particular size has been specified in relation to the preceding dots 66. However, any desired size may be selected for the preceding dots 66. In particular, if the recording head 16 is capable of forming dots having two or more sizes, then it is preferable to select a minimal size for the preceding dots 66, taking into consideration both image quality and cost, insofar as the preceding dots 66 serve as anchors for holding the ink droplets 12.

<Third Modification>

A setting for judging whether or not preceding dots 66 should be formed may be made either manually by the operator or automatically depending on attributes of a content image to be printed. Alternatively, if a monochromatic image is to be produced, preceding dots 66 in a clear color (CL) may be formed, and if a color image is to be produced, preceding dots 66 in chromatic colors including cyan (C) may be formed. For example, if dots 68 in a deep color, e.g., cyan (C), are to be formed in respective positions, then preceding dots 66 in a similar pale color, e.g., light cyan (C), may be formed at such positions in advance.

[Configuration and Operations of Image Processor 70 According to Second Embodiment]

Figure 10:
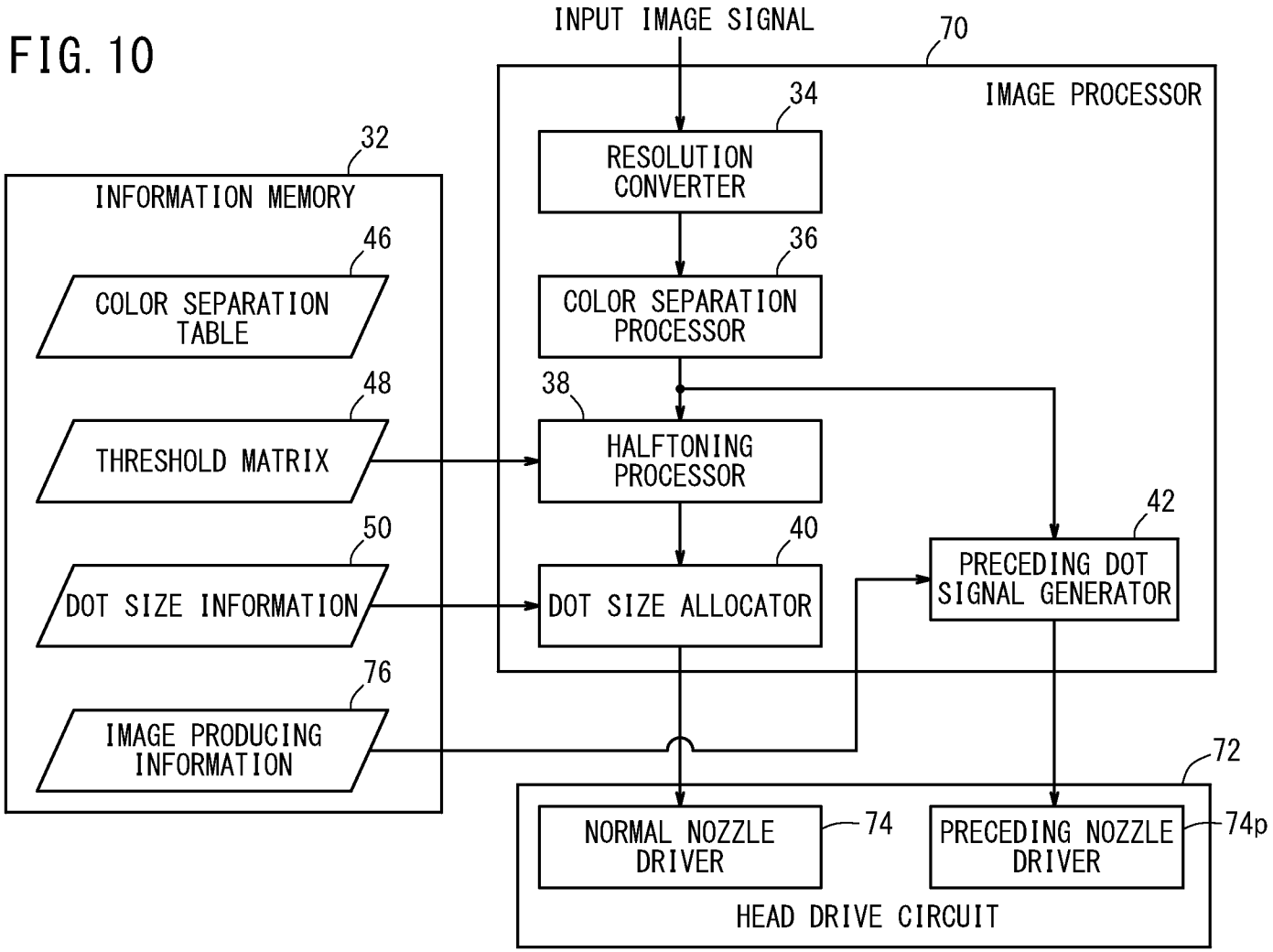
FIG. 10 is a functional block diagram of an image processor according to a second embodiment of the present invention.

FIG. 10 is a functional block diagram of an image processor 70 according to a second embodiment of the present invention. Parts of the image processor 70 according to the second embodiment, which are identical to those of the image processor 30 according to the first embodiment, are denoted by identical reference characters, and such features will not be described in detail.

<1. Arrangement of Second Embodiment>

The image processor 70 reads various data from an information memory 32, and supplies a control signal made up of combined image and preceding dot signals to a head drive circuit 72. The image processor 70 basically includes a resolution converter 34, a color separation processor 36, a halftoning processor 38, a dot size allocator 40, and a preceding dot signal generator 42. The image processor 70 lacks the signal combiner 44 (see FIG. 4).

The head drive circuit 72 includes a normal nozzle driver 74 for driving the recording head 16 based on image dot signals, in order to expel ink droplets 12, etc., from the nozzles 18 (except for the preceding nozzles 18*p*, to be described later), and a preceding nozzle driver 74*p* for driving the recording head 16 based on preceding dot signals, in order to expel preceding ink droplets 11 from the preceding nozzles 18*p*.

The information memory 32 stores various data that is required to carry out the image producing method according to the present embodiment. In FIG. 10, the information memory 32 stores a color separation table 46, a threshold matrix 48, dot size information 50, and image producing information 76.

Figure 11B:
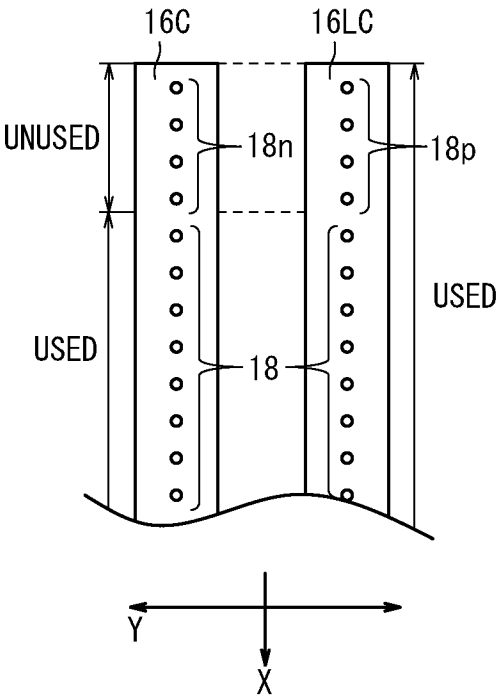
FIGS. 11A and 11B are schematic diagrams showing recording heads that carry out the image producing method according to the second embodiment.
Figure 11A:
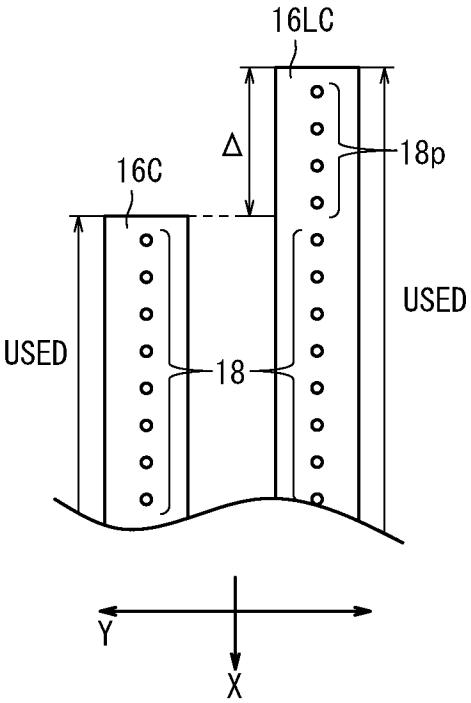

FIGS. 11A and 11B are schematic diagrams showing recording heads 16 that carry out the image producing method according to the second embodiment. As shown in FIGS. 11A and 11B, each of the recording heads 16 includes nozzle arrays 140 (see FIG. 17) for respective colors, each comprising an array of two or more nozzles 18 for expelling the ink droplets 12, etc. The array of nozzles 18 extends in the direction of the arrow X, i.e., in the feed direction along which the recording medium 10 is delivered. For illustrative purposes, only two head modules 16C, 16LC are shown in fragmentary form in FIGS. 11A and 11B.

In FIG. 11A, the head modules 16C, 16LC are shown to lie parallel to each other and to extend in the direction of the arrow X. The head module 16LC is shifted in position upstream of the head module 16C by a distance A (four times the pitch of the nozzles 18 in FIG. 11A) with respect to the feed direction, i.e., the direction of the arrow X. The head module 16LC includes four nozzles 18 serving as preceding nozzles 18*p*, which are disposed in a portion of the head module 16LC that projects upstream of the head module 16C by the distance Δ. The preceding nozzles 18*p*, which are positioned in this manner, are capable of ejecting ink droplets 11 in the color LC (pale) prior to ejecting ink droplets in other colors. The distance Δ corresponds to a distance (swathe) by which the recording medium 10 is delivered in one cycle during intermittent movement thereof. The same distance Δ also applies in FIGS. 11B and 14.

In FIG. 11B, the head modules 16C, 16LC are shown to lie parallel to each other and to extend in the direction of the arrow X. The head module 16LC is aligned with the head module 16C along the direction of the arrow X. Among the nozzles 18 of the head module 16C, four nozzles 18 (hereinafter referred to as "unused nozzles 18*n*"), which are arranged successively from the upstream end of the head module 16C with respect to the feed direction, are not used. Among the nozzles 18 of the head module 16LC, four nozzles 18, which are aligned with the unused nozzles 18*n*, are used as preceding nozzles 18*p* that are capable of ejecting ink droplets 11 in the color LC (pale) prior to ejecting ink droplets in other colors. In FIGS. 11A and 11B, the term "USED" refers to a range covering the nozzles 18 that eject the ink droplets 12, etc., whereas the term "UNUSED" refers to a range covering the unused nozzles 18*n* that do not eject the ink droplets 12, etc.

The recording heads 16 shown in FIGS. 11A and 11B are capable, physically or by means of a control process, of producing a difference between times at which the recording heads 16 expel the preceding ink droplets 11 and the normal ink droplets 12.

<2. Operations of Image Processor 70>

Operations of the image processor 70 will be described below mainly with respect to differences thereof from operations of the image processor 30 according to the first embodiment shown in FIG. 4. First, the process of generating image dot signals basically is the same as that of the first embodiment. Therefore, operations of the resolution converter 34, the color separation processor 36, the halftoning processor 38, and the dot size allocator 40 will not be described below.

The preceding dot signal generator 42 generates a preceding dot signal based on the second intermediate image signal, which is acquired from the color separation processor 36, while referring to the image producing information 76. The image producing information 76 comprises various items of information for producing an image using the recording head 16. Such items include, for example, layout information of the head modules 16LC, 16C, and array information of the nozzles 18, etc. According to the present embodiment, it is assumed that preceding dots 80 (see FIG. 12) are formed using inks in colors of LC and LM from among inks in six colors including colors of C, M, Y, K, LC, and LM.

Thereafter, the image processor 70 outputs the image dot signal, which was acquired from the dot size allocator 40, and the preceding dot signal, which was acquired from the preceding dot signal generator 42, to the head drive circuit 72. The second embodiment differs from the first embodiment, in that the image dot signal and the preceding dot signal are output without being combined by the signal combiner 44 shown in FIG. 4.

<3. Operations of Head Drive Circuit 72>

While the recording medium 10 is delivered in the feed direction, i.e., in the direction of the arrow X, the recording head 16 is moved in forward and backward scanning strokes in a transverse direction, i.e., in the direction of the arrow Y, across the recording medium 10. Upon movement of the recording head 16 in the forward scanning stroke or in the backward scanning stroke, the recording head 16 ejects ink droplets 12, etc., toward the image producing surface 22 of the recording medium 10. The preceding nozzle driver 74*p* shown in FIG. 10 controls the recording head 16 based on the preceding dot signal, in order to cause the preceding nozzles 18*p* to expel the preceding ink droplets 11 in the color LC (pale color). The normal nozzle driver 74 controls the recording head 16 based on the image dot signal, so as to cause the remaining nozzles 18 to expel ink droplets 12, 13 in colors of C and LC.

Time sequences for the formation of dots will be described below with reference to FIGS. 12, 13A, and 13B. In each of FIGS. 12, 13A, and 13B, the grid points of a square grid Gr represent respective target positions at which dots are formed on the image producing surface 22 of the recording medium 10. For illustrative purposes, the time sequences will be described while taking into account only a relationship between the colors of C and LC.

Figure 12:
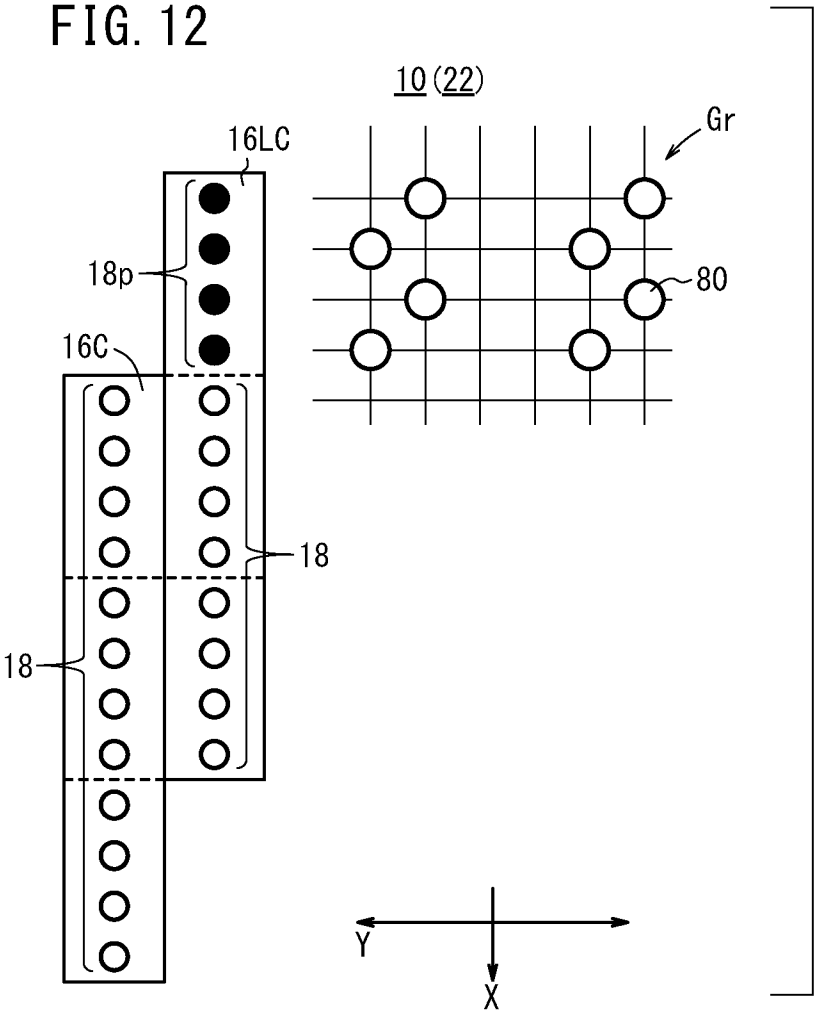
FIG. 12 is a schematic diagram showing a time sequence of a dot formation process.

As shown in FIG. 12, upon being supplied with preceding dot signals for one swathe, the recording head 16 ejects the preceding ink droplets 11 (see FIG. 3) in light cyan (LC) from the preceding nozzles 18*p* toward the recording medium 10 while moving in a forward scanning stroke, thereby forming a plurality of preceding dots 80 in respective positions at grid points of the square grid Gr in a first swathe. Thereafter, the recording medium 10 is delivered a given distance, i.e., one swathe, in the direction of the arrow X.

Figure 13B:
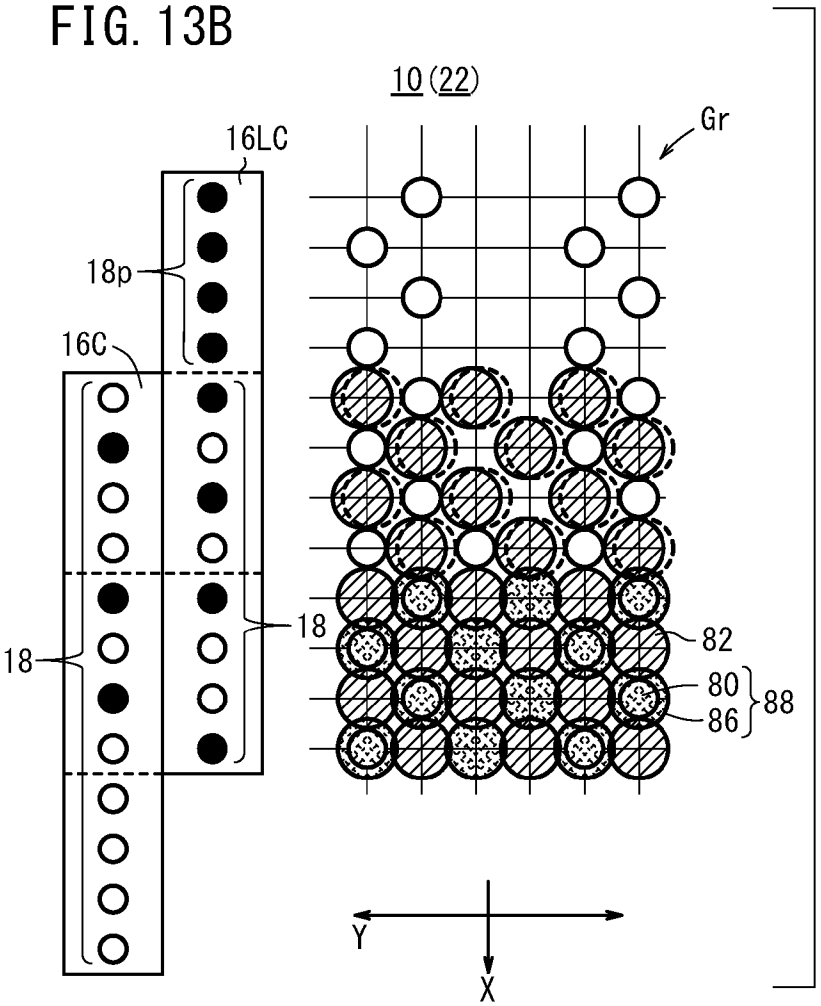
FIGS. 13A and 13B are schematic diagrams showing time sequences of a dot formation process.
Figure 13A:
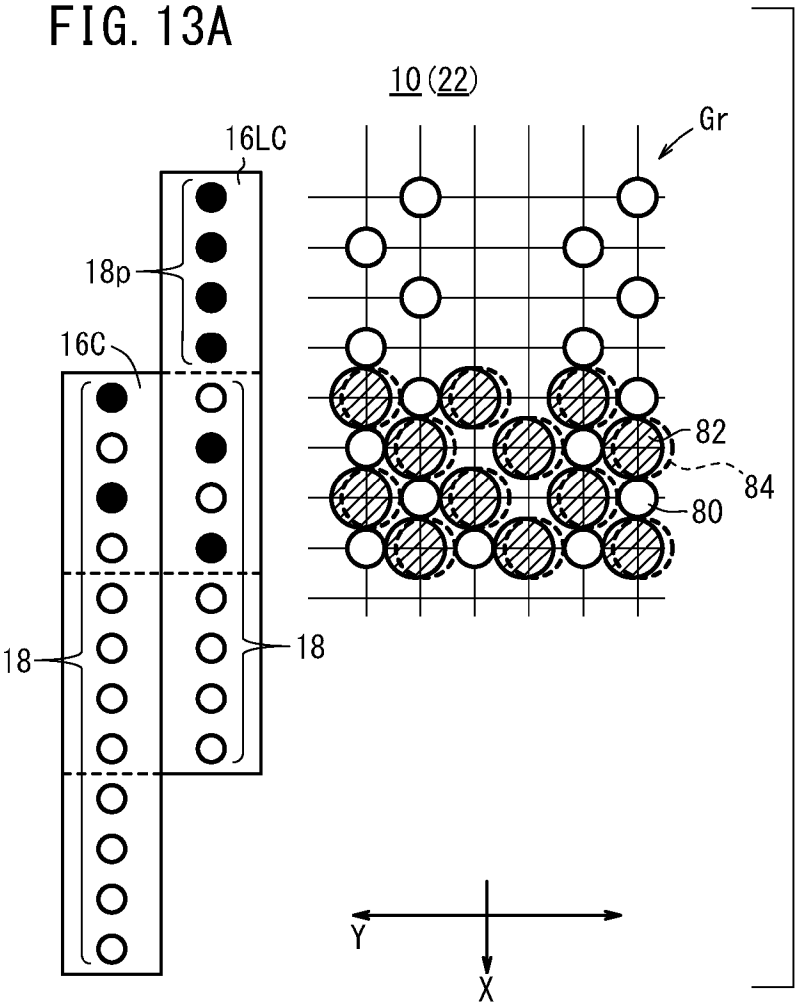

As shown in FIG. 13A, upon being supplied with image dot signals for one swathe, the recording head 16 ejects the ink droplets 12 (see FIG. 3) in at least one of cyan (C) and light cyan (LC) from the nozzles 18 toward the recording medium 10 while moving in a backward scanning stroke, thereby forming a plurality of dots 82 in respective positions at grid points of the square grid Gr in the first swathe. In FIG. 13A, the dots 82 are placed in different positions from the preceding dots 80, and are shifted slightly to the left from ideal positions 84.

At the same time, upon being supplied with preceding dot signals for one swathe, the recording head 16 ejects the preceding ink droplets 11 in light cyan (LC) from the preceding nozzles 18*p* toward the recording medium 10 while moving in the backward scanning stroke, thereby forming a plurality of preceding dots 80 in respective positions at grid points of the square grid Gr in a second swathe. Thereafter, the recording medium 10 is delivered a given distance, i.e., one swathe, in the direction of the arrow X.

As shown in FIG. 13B, upon being supplied with image dot signals for one swathe, the recording head 16 ejects the ink droplets 13 in at least one of cyan (C) and light cyan (LC) from the nozzles 18 toward the recording medium 10 while moving in a forward scanning stroke, thereby forming a plurality of dots 86 in respective positions in the first swathe. In FIG. 13B, the dots 86 are formed in the same positions as the preceding dots 80, thereby forming unitary dots 88 around the grid points of the square grid Gd. This is because the preceding ink droplets 11 serve as anchors for holding the subsequent ink droplets 13.

At the same time, upon being supplied with image dot signals for one swathe, the recording head 16 ejects the ink droplets 12 in at least one of cyan (C) and light cyan (LC) from the nozzles 18 toward the recording medium 10 while moving in the forward scanning stroke, thereby forming a plurality of dots 82 in respective positions in the second swathe.

At the same time, upon being supplied with preceding dot signals for one swathe, the recording head 16 ejects the preceding ink droplets 11 in light cyan (LC) from the preceding nozzles 18*p* toward the recording medium 10 while moving in the forward scanning stroke, thereby forming a plurality of preceding dots 80 in respective positions in a third swathe. Thereafter, the recording medium 10 is delivered a given distance, i.e., one swathe, in the direction of the arrow X.

The image processor 70 supplies the recording head 16 with the generated control signal. The recording head 16 is repeatedly moved in forward and backward scanning strokes in order to produce a desired image on the recording medium 10. Unlike the first embodiment, the recording head 16 is capable of expelling the preceding ink droplets 11 and the ink droplets 12, 13 while being moved in one scanning stroke. Therefore, the image processor 70 according to the second embodiment is capable of forming images (prints) with improved productivity.

[Modifications of Second Embodiment]

<First Modification>

In the second embodiment, it is necessary, physically or by means of a control process, to produce a difference between the times at which the preceding dots 80 and the dots 86 are formed. Therefore, the nozzles 18 that expel the ink droplets 12, etc., in a pale color may be disposed upstream of the nozzles 18 that expel the ink droplets 12, etc., in a deep color with respect to the direction of the arrow X. In other words, the recording head 16 is not limited to the structures shown in FIGS. 11A and 11B, but may have the structure described below.

Figure 14:
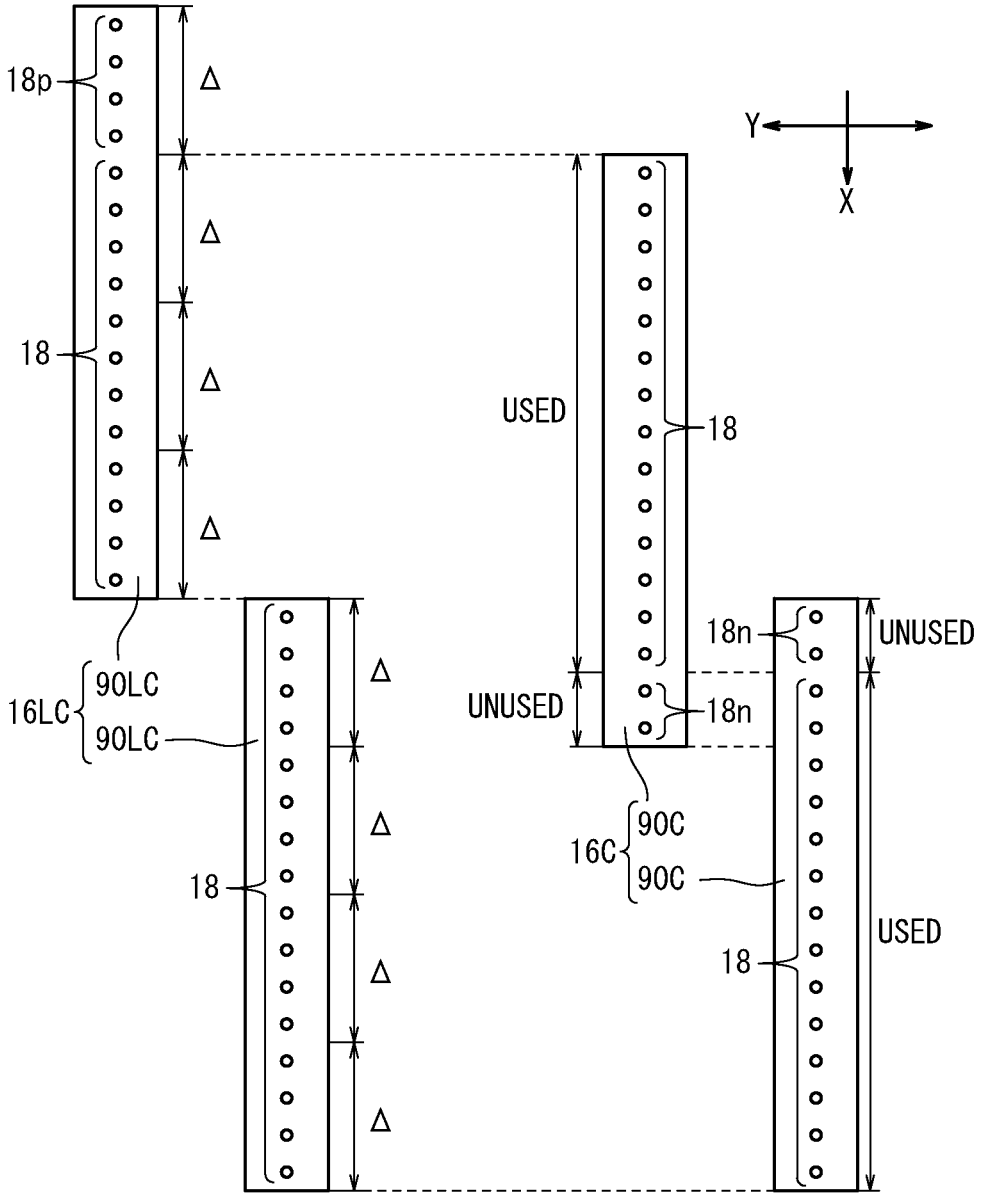
FIG. 14 is a schematic diagram showing a recording head according to a modification.

As shown in FIG. 14, head modules 16LC, 16C have unit heads 90LC, 90C, each of which includes a one-dimensional array of nozzles 18, the number and pitch of which are the same for all of the unit heads 90LC, 90C.

More specifically, the head module 16LC comprises a pair of short unit heads 90LC, 90LC, which are disposed in a staggered pattern having edges joined to each other. The head module 16C comprises a pair of short unit heads 90C, 90C, which are disposed in a staggered pattern having edges joined to each other. One of the unit heads 90LC is disposed upstream of the other unit head 90LC with respect to the direction of the arrow X, and one of the unit heads 90C is disposed upstream of the other unit head 90C with respect to the direction of the arrow X. The upstream unit head 90LC is shifted in position further upstream from the upstream unit head 90C by a distance Δ (four times the pitch of the nozzles 18 in FIG. 14) with respect to the feed direction, i.e., the direction of the arrow X. If arranged in this manner, the head modules 16LC, 16C offer the same advantages as the head modules 16C, 16LC shown in FIGS. 11A and 11B.

<Second Modification>

FIGS. 11A, 11B, and 14 show layouts of the head modules 16C, 16LC for ejecting ink droplets in similar colors, i.e., colors having different densities and similar hues. However, the same layouts as those of the head modules 16C, 16LC may be employed for ejecting ink droplets in other colors. Stated otherwise, the preceding nozzles 18*p* for ejecting the ink droplets 12, etc., in a pale color may be positioned upstream of all of the nozzles 18 of the nozzle arrays 140 (see FIG. 17) for ejecting the ink droplets 12, etc., in at least one remaining color, with respect to the feed direction, i.e., the direction of the arrow X.

[Overall Arrangement of Image Producing Apparatus 100]

FIG. 15 is a perspective view of an image producing apparatus 100 that is common to the first and second embodiments. The image producing apparatus 100 is in the form of a wide format printer for producing a color image on the recording medium 10 with ultraviolet-curable ink (UV-curable inks). Such a wide format printer comprises a printer that is capable of printing images on sheets having sizes that are equal to or greater than a size known as Super A3 (slightly greater than A3).

As shown in FIG. 15, the image producing apparatus 100 includes a main unit 102 and supporting legs 104 that support the main unit 102. The main unit 102 has a drop-on-demand recording head 16 for expelling inks toward the recording medium 10, a platen 108 on which the recording medium 10 is supported, and a guide mechanism 110 and a carriage 112 serving as a head moving means (scanning means) for moving the recording head 16.

The guide mechanism 110 is disposed above the platen 108 and extends in the scanning direction, i.e., the direction of the arrow Y, transversely across the recording medium 10. The scanning direction is perpendicular to the feed direction, i.e., the direction of the arrow X, and lies parallel to a medium support surface of the platen 108 on which the recording medium 10 is supported. The carriage 112 is supported on the guide mechanism 110 for reciprocating movement along the guide mechanism 110 in the direction of the arrow Y. The recording head 16 is mounted on the carriage 112. Provisional curing light sources 114*a*, 114*b* and final curing light sources 116*a*, 116*b*, which apply ultraviolet radiation to the inks on the recording medium 10, are supported respectively on the carriage 112.

The provisional curing light sources 114*a*, 114*b* comprise light sources for applying ultraviolet radiation in order to provisionally cure the inks to such an extent that adjacent ink droplets 12, etc., do not become united after the ink droplets 12, etc., have been ejected from the recording head 16 and deposited on the recording medium 10. The final curing light sources 116*a*, 116*b* comprise light sources for applying ultraviolet radiation in order to fully cure the inks by way of additional exposure after the inks have been provisionally cured.

The recording head 16, the provisional curing light sources 114*a*, 114*b*, and the final curing light sources 116*a*, 116*b*, which are mounted on the carriage 112, are movable in unison with the carriage 112 along the guide mechanism 110. The direction in which the carriage 112 is moved reciprocally may hereinafter be referred to as a main scanning direction, and the feed direction in which the recording medium 10 is delivered may hereinafter be referred to as an auxiliary scanning direction.

The recording medium 10 may be made of paper, nonwoven fabric, vinyl chloride, synthetic chemical fiber, polyethylene, polyester, tarpaulin, or the like, or may comprise a permeable medium or an impermeable medium. The recording medium 10 is supplied from a supply roll 124 (see FIG. 16) disposed behind the image producing apparatus 100, is delivered over the platen 108, and is wound on a take-up roll 128 (see FIG. 16) disposed in front of the image producing apparatus 100. The recording head 16 ejects ink droplets 12, etc., toward the recording medium 10 that is delivered over the platen 108, and the ink droplets 12, etc., which are deposited on the recording medium 10, are irradiated with ultraviolet radiation emitted from the provisional curing light sources 114*a*, 114*b* and the final curing light sources 116*a*, 116*b*.

The main unit 102 has a slot 120 defined in the front surface of a left-hand area thereof for receiving ink cartridges 118. The ink cartridges 118 are replaceable ink sources that store ultraviolet-curable inks. The ink cartridges 118 correspond respectively to inks in colors that are used by the image producing apparatus 100. The ink cartridges 118 are connected to the recording head 16 by way of ink supply passages, not shown, which are independent of each other.

[Feed Path of Recording Medium 10]

Figure 16:
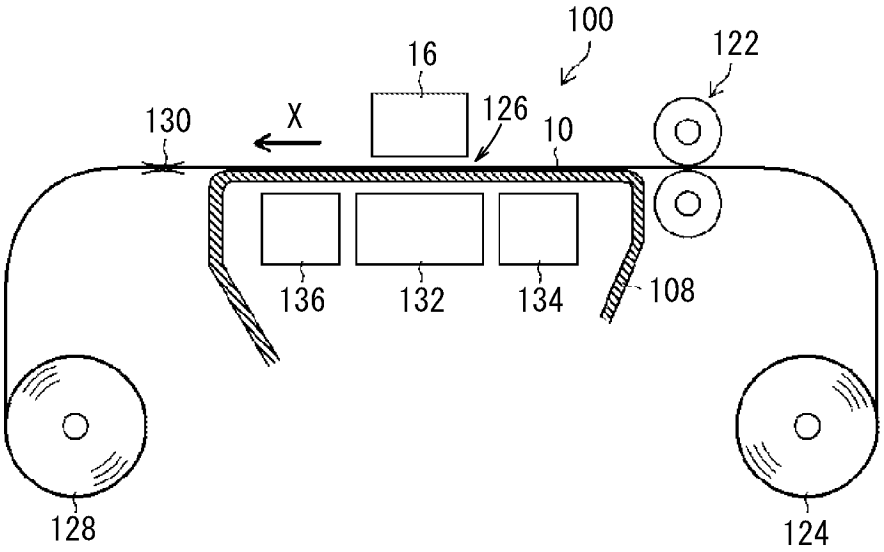
FIG. 16 is a view schematically showing a feed path for a recording medium in the image producing apparatus shown in FIG. 15.

FIG. 16 is a view showing schematically a feed path for the recording medium 10 in the image producing apparatus 100. As shown in FIG. 16, the platen 108 has a downwardly open channel-shaped cross section with an upper surface thereof serving as a medium support surface. A pair of nip rollers 122, which serve as feed means for intermittently feeding the recording medium 10, is disposed adjacent to and upstream of the platen 108 with respect to the direction of the arrow X. The nip rollers 122 move the recording medium 10 over the platen 108 in the direction of the arrow X.

The supply roll 124 and the take-up roll 128 serve as roll-to-roll feed means for feeding the recording medium 10. The recording medium 10, which is unwound from the supply roll 124, is fed intermittently in the direction of the arrow X by the nip rollers 122, which are disposed near an entry side of a printing section 126 directly below the recording head 16. Upon reaching the printing section 126, the recording medium 10 is printed by the recording head 16, after which the printed recording medium 10 is wound on the take-up roll 128. A guide 130 for guiding the recording medium 10 from the printing section 126 is disposed downstream of the printing section 126 with respect to the direction of the arrow X.

A temperature regulator 132 for regulating the temperature of the recording medium 10 while the recording medium 10 is printed is mounted on the reverse side of the platen 108, i.e., the surface of the platen 108 remote from the medium support surface, at a position opposite to the recording head 16 in the printing section 126. The temperature of the recording medium 10 while the recording medium 10 is printed is regulated to a desired temperature, whereby properties of the ink droplets 12, etc., deposited on the recording medium 10, such as viscosity, surface tension, etc., are caused to have desired values, thus making it possible to achieve a desired dot diameter. If necessary, a temperature pre-regulator 134 may be mounted on the reverse side of the platen 108 upstream of the temperature regulator 132 with respect to the direction of the arrow X, and a temperature post-regulator 136 may be mounted on the reverse side of the platen 108 downstream of the temperature regulator 132 with respect to the direction of the arrow X. If there is no need to regulate the temperature of the recording medium 10, the temperature regulator 132 may be dispensed with.

[Recording Head 16]

Figure 17:
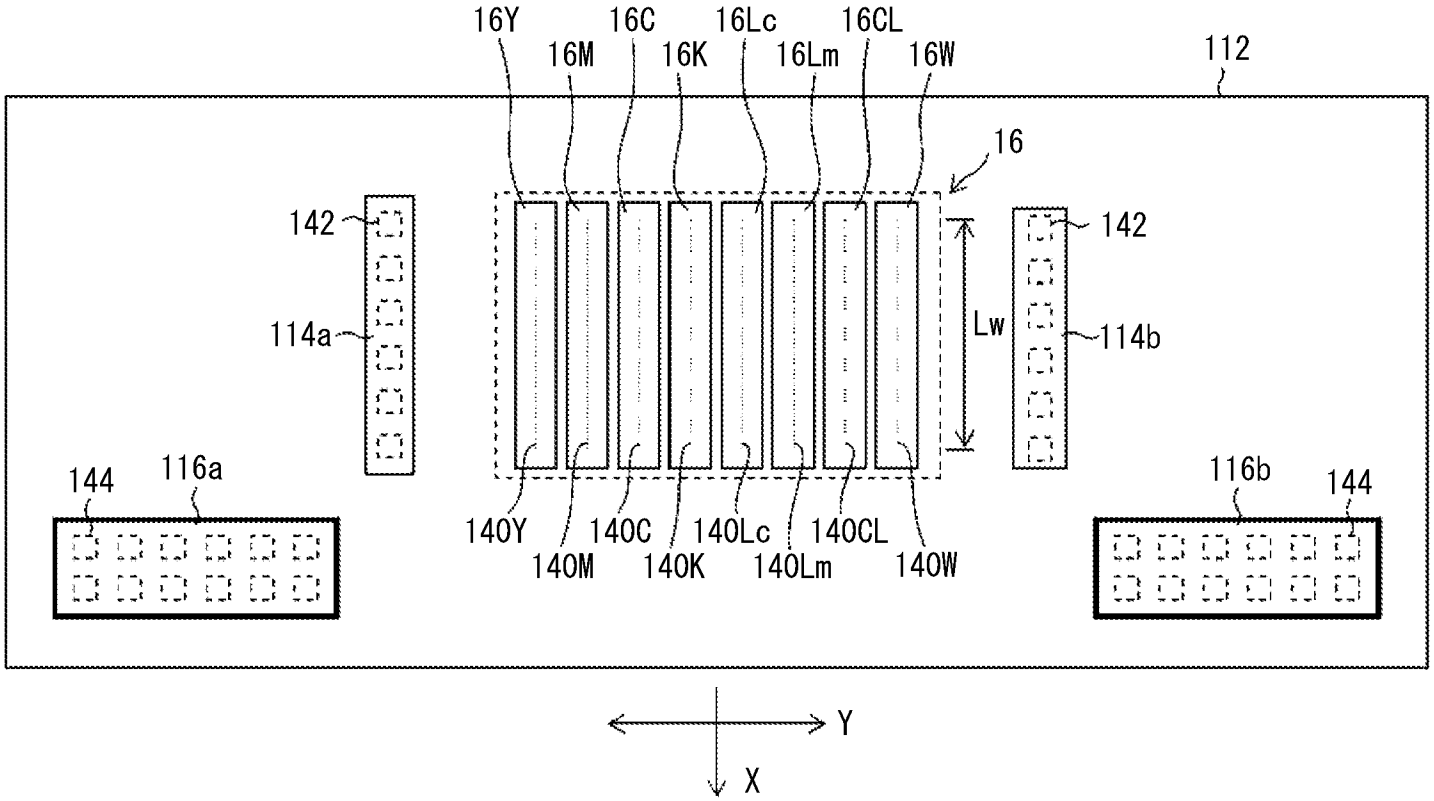
FIG. 17 is a partially transparent plan view showing an example of a recording head layout, provisional curing light sources, and final curing light sources, which are placed on a carriage shown in FIG. 15.

FIG. 17 is a partially transparent plan view of an example of the layout of the recording head 16, the provisional curing light sources 114*a*, 114*b*, and the final curing light sources 116*a*, 116*b*, which are disposed on the carriage 112.

As shown in FIG. 17, the recording head 16 includes a plurality of nozzle arrays 140Y, 140M, 140C, 140K, 140Lc, 140Lm, 140CL, 140W for ejecting inks in respective colors of yellow (Y), magenta (M) cyan (C), black (K), light cyan (LC), light magenta (LM), clear (CL), white (W). The nozzle arrays are indicated by dotted lines, with the individual nozzles thereof being omitted from illustration. The nozzle arrays 140Y, 140M, 140C, 140K, 140Lc, 140Lm, 140CL, 140W may hereinafter be referred to collectively as "nozzle arrays 140".

The types of ink colors or the number of ink colors, as well as combinations of ink colors, are not limited to those described above in the present embodiment. The nozzle arrays 140Lc, 140Lm for ejecting inks in colors of LC and LM may be omitted, the nozzle arrays 140CL, 140W for ejecting inks in colors of CL and W may be omitted, and nozzle arrays for ejecting inks in other special colors may be added. The nozzle arrays, which eject inks in different colors, are not limited to being arranged in the illustrated layout.

The nozzle arrays 140, which eject inks in different colors, serve as respective head modules. The head modules may be arranged in a certain pattern in order to provide a recording head 16 that is capable of producing a color image or a monochromatic image. For example, the nozzle arrays 140Y, 140M, 140C, 140K, 140Lc, 140Lm, 140CL, 140W for ejecting inks in colors of Y, M, C, K, LC, LM, CL, W may serve as respective head modules 16Y, 16M, 16C, 16K, 16Lc, 16Lm, 16CL, 16W, which are disposed at equal intervals in the direction of the arrow Y in which the carriage 112 is movable reciprocally. Each of the head modules, which eject inks in different colors, e.g., the head module 16Y, may be interpreted as a "recording head". Alternatively, a single recording head 16 may have ink passages defined therein for supplying inks in different colors, thus providing a nozzle array for ejecting inks in different colors.

Each of the nozzle arrays 140 includes an array of nozzles, which are spaced at uniform intervals along the direction of the arrow X. According to the present embodiment, the nozzles of each of the nozzle arrays 140 are spaced at a pitch of 254 μm, whereas each of the nozzle arrays 140 has 256 nozzles and a total length Lw of approximately 65 mm (254 μm×255=64.8 mm). The nozzles of each of the nozzle arrays 140 is capable of ejecting ink at a frequency of 15 kHz, and further is capable of ejecting ink in amounts of 10 pl, 20 pl, or 30 pl, depending on the variable waveform of a drive signal applied to the recording head 16.

The recording head 16 incorporates a piezo-jet mechanism for expelling the ink droplets 12, etc., with piezoelectric actuators that are deformable by a voltage applied thereto. Alternatively, the recording head 16 may incorporate an electrostatic mechanism for expelling the ink droplets 12, etc., with electrostatic actuators, or may incorporate a thermal-jet mechanism for expelling the ink droplets 12, etc., under the pressure of air bubbles, which are generated upon heating of the inks by heating elements such as heaters.

[Ultraviolet Radiation Applying Devices]

As shown in FIG. 17, the provisional curing light sources 114*a*, 114*b* are disposed on left and right sides of the recording head 16 along the scanning direction, i.e., the direction of the arrow Y. The final curing light sources 116*a*, 116*b* are disposed downstream of the recording head 16 with respect to the feed direction, i.e., the direction of the arrow X.

The ink droplets 12, etc., which are ejected from the nozzles of the recording head 16 and are deposited on the recording medium 10, are irradiated with ultraviolet radiation applied from the provisional curing light sources 114*a*, 114*b* for thereby provisionally curing the ink droplets 12, etc., immediately after the ink droplets 12, etc., are deposited. The ink droplets 12, etc., on the recording medium 10, which have passed through the printing section 126 (see FIG. 16) as the recording medium 10 is fed intermittently, are irradiated with ultraviolet radiation applied from the final curing light sources 116*a*, 116*b* for thereby finally curing the ink droplets 12, etc.

Each of the provisional curing light sources 114*a*, 114*b* comprises an array of six UV-LEDs (Ultraviolet Light-Emitting Diodes) 142. The two provisional curing light sources 114*a*, 114*b* share a common structure. The six UV-LEDs 142 are arranged to apply ultraviolet radiation over an area having a width that is the same as the total length Lw of the nozzle arrays 140 of the recording head 16.

Each of the final curing light sources 116*a*, 116*b* comprises a dual array of UV-LEDs (Ultraviolet Light-Emitting Diodes) 144. The two final curing light sources 116*a*, 116*b* share a common structure. In each of the final curing light sources 116*a*, 116*b*, the UV-LEDs 144 are arranged in a matrix of six columns, which are spaced along the direction of the arrow Y, and two rows, which are spaced along the direction of the arrow X.

The number and layout of the LEDs in the provisional curing light sources 114*a*, 114*b* and the final curing light sources 116*a*, 116*b* are not limited to those shown in FIG. 17. If necessary, the provisional curing light sources 114*a*, 114*b* may be dispensed with, and only the final curing light sources 116*a*, 116*b* may be used.

[Ink Supply System]

Figure 18:
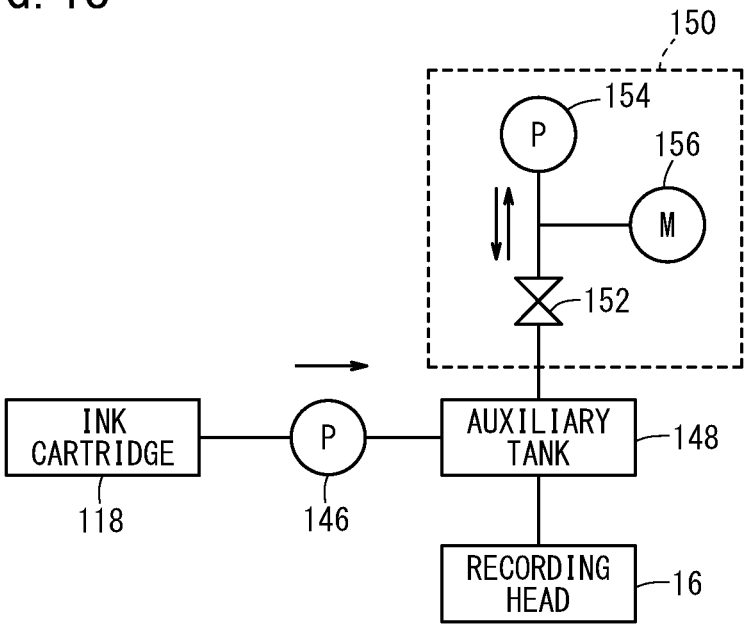
FIG. 18 is a block diagram of an ink supply system of the image producing apparatus.

FIG. 18 is a block diagram of an ink supply system of the image producing apparatus 100. As shown in FIG. 18, ink stored in an ink cartridge 118 is drawn by a supply pump 146 into an auxiliary tank 148, from which the ink is delivered to the recording head 16. The auxiliary tank 148 is combined with a pressure regulator 150 for regulating the pressure of the ink stored in the auxiliary tank 148.

The pressure regulator 150 includes a valve 152, a pressurizing/depressurizing pump 154 held in fluid communication with the auxiliary tank 148 through the valve 152, and a pressure meter 156 connected between the valve 152 and the pressurizing/depressurizing pump 154.

While the image producing apparatus 100 functions in a normal printing mode, the pressurizing/depressurizing pump 154 operates to draw ink from the auxiliary tank 148, thereby maintaining a negative pressure in the auxiliary tank 148 and the recording head 16.

While the recording head 16 is undergoing maintenance, the pressurizing/depressurizing pump 154 operates to pressurize the ink in the auxiliary tank 148. Pressure in the auxiliary tank 148 and in the recording head 16 is increased in order to discharge ink from the recording head 16 through the nozzle arrays 140 (see FIG. 17).

[Control System of Image Producing Apparatus 100]

Figure 19:
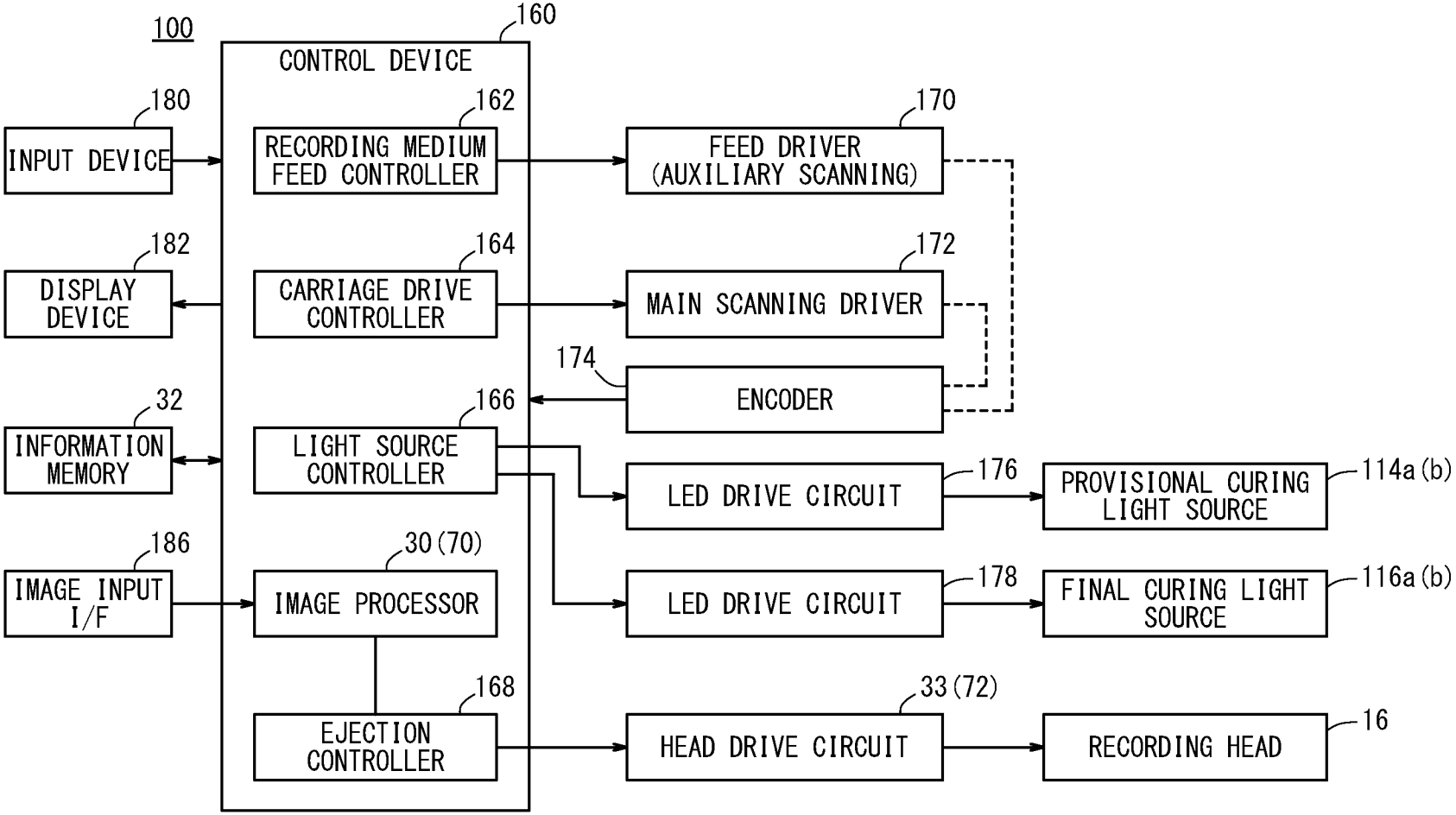
FIG. 19 is a block diagram of the image producing apparatus.

FIG. 19 is a block diagram of the image producing apparatus 100. As shown in FIG. 19, the image producing apparatus 100 includes a control device 160 that serves as a control means. The control device 160 may be in the form of a computer having a central processing unit. The control device 160 functions as a control device for controlling the image producing apparatus 100 in its entirety according to a program, which the control device 160 reads and executes from a memory. The control device 160 also functions as an arithmetic unit for performing various arithmetic operations.

The control device 160 includes a recording medium feed controller 162, a carriage drive controller 164, a light source controller 166, the image processor 30 (70) (see FIGS. 4 and 10), and an ejection controller 168. The elements of the control device 160 are implemented by hardware circuits, software components, or a combination thereof.

The recording medium feed controller 162 controls a feed driver 170 (feed means) for feeding the recording medium 10

(see FIG. 16). The feed driver 170 includes a drive motor for rotating the nip rollers 122 (see FIG. 16), and a drive circuit for energizing the drive motor. The recording medium 10, which is fed over the platen 108 (see FIG. 16), is fed intermittently in the auxiliary scanning direction by a distance corresponding to a swathe, in timed relation to the reciprocating movement of the recording head 16 in the main scanning direction, i.e., movement of the recording head 16 along a print path.

The carriage drive controller 164 controls a main scanning driver 172 (scanning driver) for moving the carriage 112 (see FIG. 15) in the main scanning direction. The main scanning driver 172 includes a drive motor, which is coupled to a mechanism for moving the carriage 112, and a control circuit for controlling the drive motor.

An encoder 174 is connected to the drive motor of the main scanning driver 172 and to the drive motor of the feed driver 170. The encoder 174 outputs pulse signals, which depend on the angular displacement and rotational speed of the drive motors, to the control device 160. Based on the pulse signals output from the encoder 174, the control device 160 is capable of recognizing the position of the carriage 112 and the position of the recording medium 10.

The light source controller 166 controls an LED drive circuit 176 in order to regulate the amount of ultraviolet radiation emitted from the provisional curing light sources 114*a*, 114*b* (UV-LEDs 142). The light source controller 166 also controls an LED drive circuit 178 in order to regulate the amount of ultraviolet radiation emitted from the final curing light sources 116*a*, 116*b* (UV-LEDs 144).

The LED drive circuits 176, 178 output voltages having voltage values that depend on commands from the light source controller 166, in order to adjust the amount of ultraviolet radiation emitted from the UV-LEDs 142, 144. Alternatively, the LED drive circuits 176, 178 may change the duty ratio or the frequency of the drive signals, rather than the voltage values, in order to adjust the amount of ultraviolet radiation emitted from the UV-LEDs 142, 144.

An input device 180, such as an operation panel or the like, and a display device 182 are connected to the control device 160. The input device 180, which enables manual operation signals to be entered into the control device 160, may be in any of various forms such as a keyboard, a mouse, a touch panel, operation buttons, etc. The display device 182 may comprise any of various display devices such as a liquid crystal display device, an organic EL (ElectroLuminescence) display device, a CRT (Cathode Ray Tube) display device, etc. The operator operates the input device 180 to enter printing conditions, as well as to enter and edit ancillary information. The operator can see the information displayed on the display device 182 in order to confirm various items of information, such as items that are entered, and searched or browsed results.

The information memory 32, which stores various items of information, and an image input I/F 186 for acquiring input image signals also are connected to the control device 160. The image input I/F 186 may comprise a serial interface or a parallel interface, including a buffer memory, not shown, for enabling faster communications.

The information memory 32 stores programs to be executed by a CPU, not shown, of the control device 160, together with various data required for the control device 160 to carry out control processes. The data stored in the information memory 32 include the color separation table 46, the threshold matrix 48, the dot size information 50, and the image producing information 76 shown in FIG. 10, for example.

The image processor 30 (70) performs a desired image processing technique on the input image signals acquired through the image input I/F 186 in order to generate control signals for controlling ejection of the ink droplets 12, etc. The image processor 30 shown in FIG. 30 basically includes the resolution converter 34, the color separation processor 36, the halftoning processor 38, the dot size allocator 40, the preceding dot signal generator 42, and the signal combiner 44 shown in FIG. 4. Since functions and operations of such components have already been described above, these features will not be described below.

The ejection controller 168 generates ejection control signals for the head drive circuit 33 (72), based on control signals acquired from the image processor 30 (70). Based on the ejection control signals, the head drive circuit 33 (72) applies a common drive voltage signal to non-illustrated ejection energy generating elements of the recording medium 10, and turns on and off non-illustrated switching elements, which are connected to individual electrodes of the ejection energy generating elements, depending on the timing at which ink droplets are expelled from the nozzles, thereby ejecting the ink droplets 12, etc., from respective nozzles of the nozzle arrays 140 (see FIG. 17).

[Advantages of the Present Invention]

As described above, the image producing apparatus 100 includes the recording head 16 for ejecting the ink droplets 12, etc., to form dots (66, 68, 80, 82, 86) in a plurality of colors having different shades on the recording medium 10, the head drive circuit 33 (72) for controlling the recording head 16 based on a control signal to successively form dots (preceding dots 66, etc.) at a plurality of timings on the recording medium 10 in order to generate image arrays transversely across the recording medium 10 (in the direction of the arrow Y) while the recording medium 10 is moved in the feed direction (the direction of the arrow X) with respect to the recording head 16, and the image processor 30 (70) for generating a control signal, which is supplied to the head drive circuit 33 (72), from an input image signal.

If the dots (preceding dots 66, etc.) formed along the direction of the arrow Y are classified into plural groups depending on a plurality of timings, then the preceding dots 66, 80, which belong to a group having an earliest timing, are formed in a pale color. Consequently, any adverse physical effects due to interference between the deposited ink droplets 12, etc., can be reduced, and the shape of the dots 68, 82, 86 produced by the deposited ink droplets 12, etc., can be controlled appropriately.

More specifically, the ink droplets (preceding ink droplets 11), which are ejected at an earliest timing during production of image arrays along the direction of the arrow Y, are effective to hold the ink droplets 12, which are ejected subsequently toward positions in the vicinity of the deposited preceding ink droplets 11, and to prevent the ink droplets 12 from being shifted toward the other ink droplets 13. Accordingly, interference between deposited ink droplets is prevented from occurring in succession, so that a reduction in the quality and appearance of an image, caused by interference between the deposited ink droplets, can be suppressed. In particular, since the preceding ink droplets 11 are pale in color, even if the preceding ink droplets 11 become united with the subsequently deposited ink droplets 12, any adverse effect on the resultant image due to mixed colors is minimized.

If an ink containing a pigment having a relatively large particle diameter is used, for example, then many inclusions of the ink may be left on the image producing surface 22. If an ink is used that is curable upon exposure to active light rays, then surface irregularities tend to be developed on the recording medium 10 in a case where an image is produced using the ink on the recording medium 10, because the recording medium absorbs almost none of the ink. Inasmuch as these types of inks are highly likely to cause interference between deposited ink droplets which occur in succession on the image producing surface 22, the present invention is highly effective in applications where such inks are used.

The present invention is not limited to the above embodiments, but various changes and modifications may be made to the embodiments without departing from the scope of the invention.

In the above embodiments, images are produced using ultraviolet-curable inks. However, different types of inks, which are curable by active light rays other than ultraviolet radiation, may also be used. If such different types of inks are used, then light sources for emitting active light rays other than ultraviolet radiation may be used as provisional curing light sources and as final curing light sources.

In the above embodiments, a wide format printer is illustrated as the image producing apparatus. However, the present invention is not limited to a wide format printer, but other image producing apparatus apart from a wide format printer may also be used. Furthermore, the present invention is not limited to a graphic art (printing) application, but may also be applied to image producing apparatus for producing various image patterns, such as wiring pattern printers for electronic circuit boards, fabrication apparatus for manufacturing various devices, resist printers that make use of a resinous liquid as a functional liquid (corresponding to an ink) that is expelled, and microstructure producing apparatus.

What is claimed is:

1. An image producing apparatus comprising:

a recording head for ejecting ink droplets to form dots in a plurality of colors having different shades on a recording medium;

a head drive circuit for controlling the recording head based on a control signal to successively form the dots at a plurality of timings on the recording medium, to thereby generate image arrays in a transverse direction across the recording medium while the recording medium is moved in a feed direction with respect to the recording head; and an image processor for generating the control signal, which is supplied to the head drive circuit, from an input image signal, so that if the dots formed along the transverse direction are classified into plural groups depending on the plurality of timings, then preceding dots, which belong to a group having an earliest timing, are formed in a pale color, wherein the image processor comprises:

a halftoning processor for performing a halftoning process on the input image signal to generate an image dot signal; and a preceding dot signal generator for generating a preceding dot signal representing information concerning the preceding dots based on the input image signal, wherein the control signal includes the image dot signal generated by the halftoning processor and the preceding dot signal generated by the preceding dot signal generator, and wherein the preceding dot signal generator generates the preceding dot signal, so as to form the preceding dots at positions identical or adjacent to dots in a deep color, in a density gradation range that is equal to or greater than a preset threshold value.

2. The image producing apparatus according to claim 1, further comprising:

a scanning driver for reciprocally moving the recording head along the transverse direction; and a feed driver for feeding the recording medium along the feed direction.

3. The image producing apparatus according to claim 2, wherein the image processor generates the control signal by successively combining the preceding dot signal and the image dot signal alternately in respective scanning strokes of the recording head; and the head drive circuit controls the recording head based on the preceding dot signal in a forward scanning stroke of the recording head that is moved by the scanning driver, and controls the recording head based on the image dot signal in a backward scanning stroke of the recording head occurring subsequently to the forward scanning stroke.

4. The image producing apparatus according to claim 2, wherein the recording head includes nozzle arrays for respective colors, each of the nozzle arrays having at least two nozzles extending in the feed direction for ejecting the ink droplets; and the nozzle arrays include preceding nozzles for ejecting ink droplets in a pale color, the preceding nozzles being positioned upstream of all remaining nozzles of the nozzle arrays, which are capable of ejecting ink droplets in at least one remaining color.

5. The image producing apparatus according to claim 4, wherein the head drive circuit controls the recording head based on the preceding dot signal, so as to cause the preceding nozzles to eject the ink droplets in the pale color, and controls the recording head based on the image dot signal to cause the remaining nozzles to eject the ink droplets.

6. The image producing apparatus according to claim 1, wherein the recording head forms the dots in at least two sizes on the recording medium; and the image processor generates the control signal to form the preceding dots in a smallest one of the at least two sizes.

7. The image producing apparatus according to claim 1, wherein the plurality of colors include a transparent color; and the image processor generates the control signal to form the preceding dots in the transparent color.

8. The image producing apparatus according to claim 1, wherein the ink droplets comprise inks that are curable upon exposure to ultraviolet radiation.

9. An image producing method to be carried out by an apparatus having a recording head for ejecting ink droplets to form dots in a plurality of colors having different shades on a recording medium, wherein the dots are successively formed at a plurality of timings on the recording medium, to thereby generate image arrays in a transverse direction across the recording medium while the recording medium is moved in a feed direction with respect to the recording head, the image producing method comprising:

inputting an image signal;

generating a control signal from the input image signal, so that if the dots formed along the transverse direction are classified into plural groups depending on the plurality of timings, then preceding dots, which belong to a group having an earliest timing, are formed in a pale color;

controlling the recording head based on the generated control signal, performing a halftoning process on the input image signal to generate an image dot signal; and generating a preceding dot signal representing information concerning the preceding dots based on the input image signal, wherein the control signal includes the image dot signal generated by the performing the halftoning process and the preceding dot signal generated by the generating the preceding dot signal, and wherein the generating the preceding dot signal generates the preceding dot signal, so as to form the preceding dots at positions identical or adjacent to dots in a deep color, in a density gradation range that is equal to or greater than a preset threshold value.

10. The image producing apparatus method to claim 9, wherein the ink droplets comprise inks that are curable upon exposure to ultraviolet radiation.

* * * * *